US011819990B2

(12) United States Patent
Ishikawa

(10) Patent No.: US 11,819,990 B2
(45) Date of Patent: Nov. 21, 2023

(54) DRIVING TOOL

(71) Applicant: MAKITA CORPORATION, Anjo (JP)

(72) Inventor: Naoharu Ishikawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/868,253

(22) Filed: Jul. 19, 2022

(65) Prior Publication Data

US 2023/0078054 A1 Mar. 16, 2023

(30) Foreign Application Priority Data

Sep. 10, 2021 (JP) ..... 2021-147520

(51) Int. Cl.
*B25C 1/04* (2006.01)
*B25C 1/00* (2006.01)

(52) U.S. Cl.
CPC ..... *B25C 1/043* (2013.01); *B25C 1/008* (2013.01); *B25C 1/047* (2013.01)

(58) Field of Classification Search
CPC ..... B25C 1/043; B25C 1/047; B25C 1/008; B25C 1/04; B25C 1/041; B25C 1/06
See application file for complete search history.

(56) References Cited

U.S. PATENT DOCUMENTS 5,732,870 A 3/1998 Moorman et al.
5,772,096 A 6/1998 Osuka et al.
5,918,788 A 7/1999 Moorman et al.
6,382,492 B1 5/2002 Moorman et al.
6,431,425 B1 8/2002 Moorman et al.
9,381,633 B2 7/2016 Moore et al.
9,550,288 B2 1/2017 Moore et al.
9,782,880 B2 10/2017 Moore et al.
10,213,911 B2 2/2019 Moore et al.
10,926,387 B2 2/2021 Moore et al.
11,052,522 B2 7/2021 Ishikawa et al.
2014/0110450 A1 4/2014 Moore et al.
2014/0110452 A1 4/2014 Moore et al.
2016/0279774 A1 9/2016 Moore et al.
2017/0129084 A1 5/2017 Moore et al.
2019/0184536 A1 6/2019 Moore et al.
2020/0171638 A1* 6/2020 Meredith ..... B25C 1/046
2021/0154816 A1 5/2021 Moore et al.

FOREIGN PATENT DOCUMENTS

JP 3287172 B2 5/2002
JP 2018-144122 A 9/2018

* cited by examiner

*Primary Examiner* — Anna K Kinsaul
*Assistant Examiner* — Veronica Martin
(74) *Attorney, Agent, or Firm* — Oliff PLC

(57) ABSTRACT

A contact restriction member is configured to move from an unlock position to a lock position within a predetermined time period by using an intermittent rotation movement of a restriction wheel. The contact restriction member may prevent substantial movement of a contact arm when the contact restriction member is in the lock position.

19 Claims, 20 Drawing Sheets

DRIVING TOOL

CROSS-REFERENCE TO RELATED APPLICATIONS

This application claims priority to Japanese patent application serial number 2021-147520, filed on Sep. 10, 2021, the contents of which are incorporated herein by reference in their entirety for all purposes.

BACKGROUND

The present disclosure generally relate to a driving tool, such as a nail gun, etc.

For example, in nail guns in which compressed air is used as a driving force, a driving operation is configured to be performed by a main body. This operation is performed on the condition that a contact arm provided at a tip end of a nose part of the main body is moved upward with respect to an injection opening, and on the condition that, while the contact arm is being pushed upward by a workpiece (an on-operation of the contact arm), a trigger is pulled by a fingertip (an on-operation of the trigger). The driving operation is configured so as not to be performed upon only one of the above on-operations, thereby preventing an inadvertent driving operation.

Furthermore, in these conventional types of driving tools, various driving operations can be performed. For instance, the driving operations may include a focused driving operation, in which the trigger is pulled after the contact arm has been on-operated by pushing the contact arm toward a workpiece. The driving operation may also include a swung driving operation in which the contact arm is on/off operated by moving the driving tool in an up-and-down direction while the trigger is kept pulled. In the focused driving operation, unless the trigger is released after the driving operation has been performed, the next driving operation cannot be performed (a single driving mode). On the other hand, in the swung driving operation, a continuous driving operation can be performed while the trigger is kept pulled (a continuous driving mode).

For example, an electrically controlled solenoid valve may move a head valve to control supply and interruption of compressed air with respect to a driving section. As another examples, a driving tool in which a single driving mode and a continuous driving mode can be selected by using an electrically controlled solenoid valve. By using an electrically controlled solenoid valve (which may be referred to as a starting valve), driving movements such as the single driving mode and the continuous driving mode can be controlled appropriately. However, in each of the above conventional tools, compressed air is used as a part of a power source to move a valve stem of the starting valve. It takes time to perform an on/off movement of the starting valve, which in turn decreases the speed of performing the driving movement.

In some situations, each of the on-operations of the contact arm and of the trigger can be detected by a micro-switch. For example, an elapsed time after the on-operation of the contact arm is measured by a timer. According to this mode switch technique, a driving operation can be performed by the on-operation of the trigger within a predetermined time period after the contact arm has been on-operated. After a driving movement has been performed, a continuous driving inhibition state can be reset by an off-operation of the trigger. In the continuous driving mode, a driving operation can be repeated on the condition that an on-operation of the contact arm is performed within a predetermined time period of the on-operation of the trigger. In contrast, when the on-operation of the contact arm is not performed within the predetermined time period, as measured by the timer, the on-operation of the contact arm does not cause the tool to perform a driving operation. Instead, the tool is forced into a driving operation inhibition state by locking the contact arm in an off position with a lock pin. According to this mode selection technique, for example while the tool is in the continuous driving mode, when the tool is being carried while the trigger is being on-operated, an inadvertent driving operation can be prevented, even in a case where the contact arm is mistakenly on-operated by being touched to other members.

According to the techniques disclosed above, a manual operation type starting valve is not used, thereby avoiding speed performance problems. However, in a case where the remaining capacity of a battery has decreased and power is not being supplied to, for example, a controller that receives the input signals from the micro-switch or other devices, or in a case where power supply is shut off, a driving operation cannot be performed at all, thereby stopping a user from working. In this respect, all three of the techniques disclosed above have the same problem. More precisely, when the electric power supply is interrupted, the starting valve cannot be activated, thereby preventing any further driving operations.

However, a timer mechanism configured to have a mechanical configuration can be used to prevent an inadvertent driving operation of the contact arm. Thus, in some situations, a driving operation can be performed under an environment where electric power cannot be supplied.

SUMMARY

However, the above mechanical timer mechanism includes a rotary damper in which silicon oil is sealed, thereby causing an operation speed of the timer mechanism to be unstable, at least in part due to being affected by heat. Thus, there is a need in the art to provide a timer mechanism that has a stable operation speed without being affected by heat.

According to one aspect of the present disclosure, a driving tool comprises a tool main body that performs a driving operation on a condition that both a movement of a trigger to a trigger-on position and a movement of a contact arm to an arm-on position are both been performed. The driving tool also comprises a contact restriction member that is movable between an unlock position, at which the contact arm is allowed to move to the arm-on position, and a lock position, at which the contact arm is prevented from moving to the arm-on position. The driving tool also comprises a timer mechanism that starts its operation when the trigger moves to the trigger-on position while the contact arm is at an arm-off position. The timer mechanism moves the contact restriction member to the lock position after a predetermined time period has passed. Furthermore, the timer mechanism includes a restriction wheel that specifies the predetermined time period by rotation of the restriction wheel and that is in an interlocking relationship with a movement of the contact restriction member to the lock position. The movement of the contact restriction member is performed when the trigger has moved to the trigger-on position. The timer mechanism also includes a resistance applying member that intermittently applies a rotational resistance to the restriction wheel.

Because of this configuration, the contact restriction member is at the unlock position when the trigger is at the trigger-off position. When the contact restriction member is at the unlock position, the contact arm is allowed to move to a contact-on position. When the trigger moves to the trigger-on position, the contact restriction member of the timer mechanism moves from the unlock position toward the lock position during the predetermined time period, if the contact arm is in the contact-off position. When the contact restriction member is at the lock position, the contact arm is prohibited from moving to the on-position. Because of this configuration, an inadvertent driving operation of the tool main body can be prevented.

The predetermined time period during which the contact restriction member moves from the unlock position to the lock position is specified by the intermittent rotation of the restriction wheel. The intermittent rotation of the restriction wheel is performed by the resistance applying member that intermittently applies the rotational resistance to the restriction wheel. Because of this configuration, an influence of heat, which was an issue for the above-described conventional technique that uses a rotary damper in which silicon oil is sealed to produce the predetermined time period, can be eliminated, thereby obtaining a more stable operation speed of the timer mechanism. The restriction wheel and the resistance applying member respectively correspond to an escape wheel and an anchor in a timepiece escapement. In the timepiece escapement, an intermittent rotation movement of the escape wheel can be performed by two ends of the anchor that alternately contact the escape wheel.

DETAILED DESCRIPTION

Figure 1:
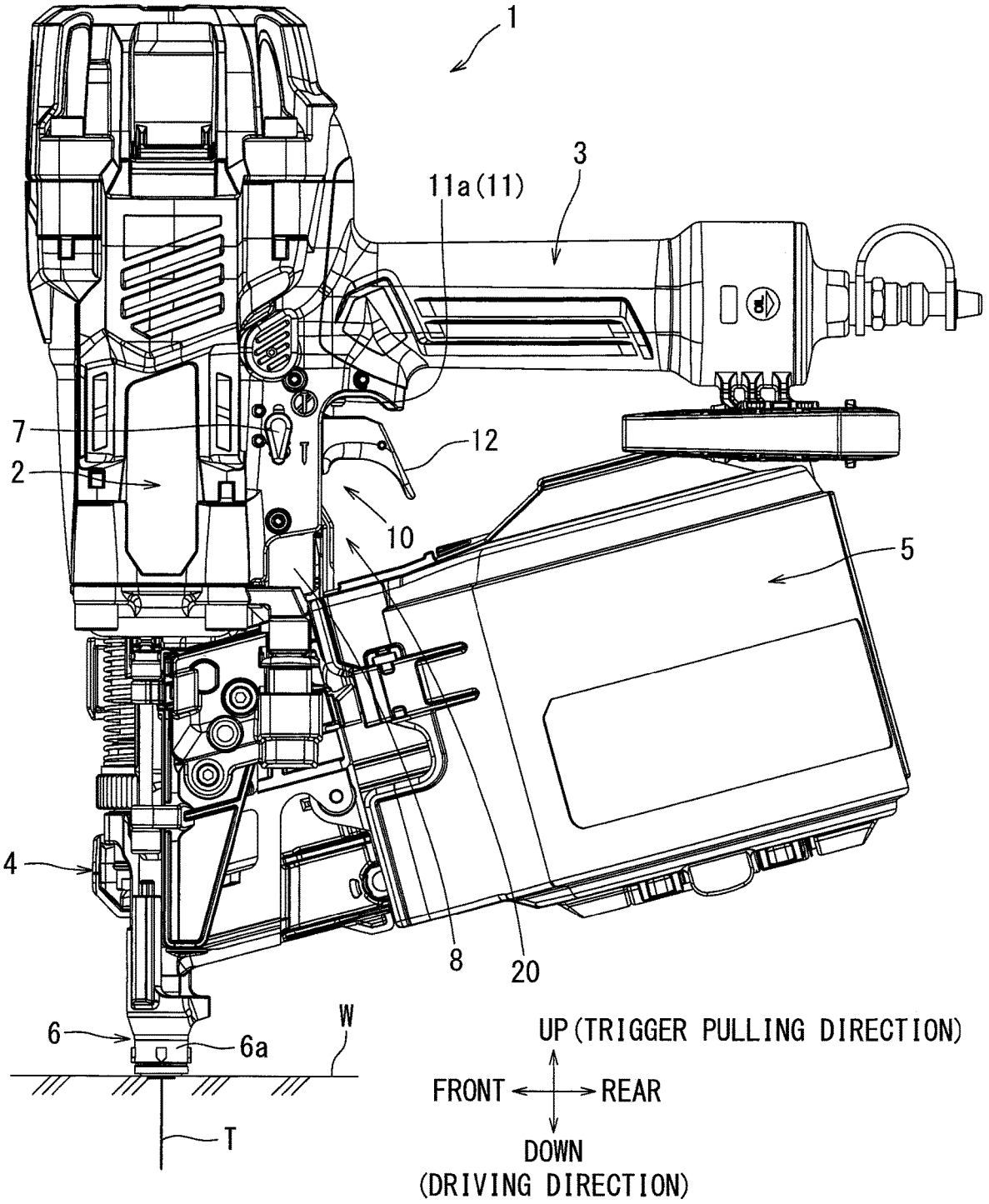
FIG. 1 is a left side view of a driving tool according to an exemplary embodiment of the present disclosure.

The detailed description set forth below, when considered with the appended drawings, is intended to be a description of exemplary embodiments of the present disclosure and is not intended to be restrictive and/or representative of the only embodiments in which the present disclosure can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the disclosure. It will be apparent to those skilled in the art that the exemplary embodiments of the disclosure may be practiced without these specific details. In some instances, these specific details refer to well-known structures, components, and/or devices that are shown in block diagram form in order to avoid obscuring significant aspects of the exemplary embodiments presented herein.

According to one aspect of the present disclosure, a resistance applying member is swingably linked to the tool main body and includes a contact portion that intermittently contacts a restriction wheel. Accordingly, the resistance applying member swings with respect to the tool main body and the contact portion of the resistance applying member intermittently contacts the restriction wheel. As a result, a rotational resistance is intermittently applied to the restriction wheel, thereby intermittently rotating the restriction wheel.

According to one aspect of the present disclosure, the restriction wheel contacts the contact portion of the resistance applying member by rotation of the restriction wheel in a predetermined direction, thereby swinging the resistance applying member. Because of this configuration, the restriction wheel intermittently receives the rotation resistance from the resistance applying member, thereby intermittently rotating the restriction wheel.

According to one aspect of the present disclosure, the resistance applying member includes two claws functioning as the contact portion, and the two claws are configured to alternately contact the restriction wheel. Accordingly, the two claws of the resistance applying member alternately contact the restriction wheel, thereby indirectly applying the rotational resistance to the restriction wheel.

According to one aspect of the present disclosure, the resistance applying member is symmetric with respect to a line passing through a swing center thereof. Because of this configuration, the two symmetrically arranged claws alternately contact the restriction wheel due to the swing of the resistance applying member.

According to one aspect of the present disclosure, the timer mechanism includes a plurality of stages of a gear train through which a rotational movement of the gear train is transmitted to the restriction wheel with increased speed. The rotational movement is configured to be performed by the movement of a trigger to a trigger-on position. Because of the gear train increasing the speed, the restriction wheel and the resistance applying member can be made compact and a length of the predetermined time period can be set appropriately.

According to one aspect of the present disclosure, the restriction wheel is rotatably supported via a first shaft that is commonly used by at least one of the gears of the gear train. Thus, a configuration of the timer mechanism can be made simple and compact.

According to one aspect of the present disclosure, the resistance applying member is swingably supported via a second shaft that is commonly used by at least one gear of the gear train. Thus, a configuration of the timer mechanism can be made simple and compact.

According to one aspect of the present disclosure, a one-way clutch is included in a power transmission path of the gear train. Because of this configuration, the power transmission path of the gear train can be disconnected, thereby allowing for the trigger to be rapidly returned without substantially receiving an effect of the intermittent movement of the restriction wheel.

According to one aspect of the present disclosure, both the restriction wheel and the resistance applying member are housed in a mechanism case in a sealed manner. Accordingly, the restriction wheel and the resistance applying member can be kept free of dust (and entry of other foreign matter can be prevented), thereby maintaining a stable predetermined time period.

According to one aspect of the present disclosure, the mechanism case includes a shield wall member that shields the contact restriction member in a lateral direction. The shield wall member includes a window through which the contact restriction member is visually recognized. Accordingly, a movement state of the contact restriction member can be rapidly confirmed. By visually confirming the movement state of the contact restriction member through the window, a user can indirectly confirm a dustproof state within the mechanism case. In other words, a user can confirm whether foreign matter has entered the mechanism case and is causing an operation failure or not.

Figure 2:
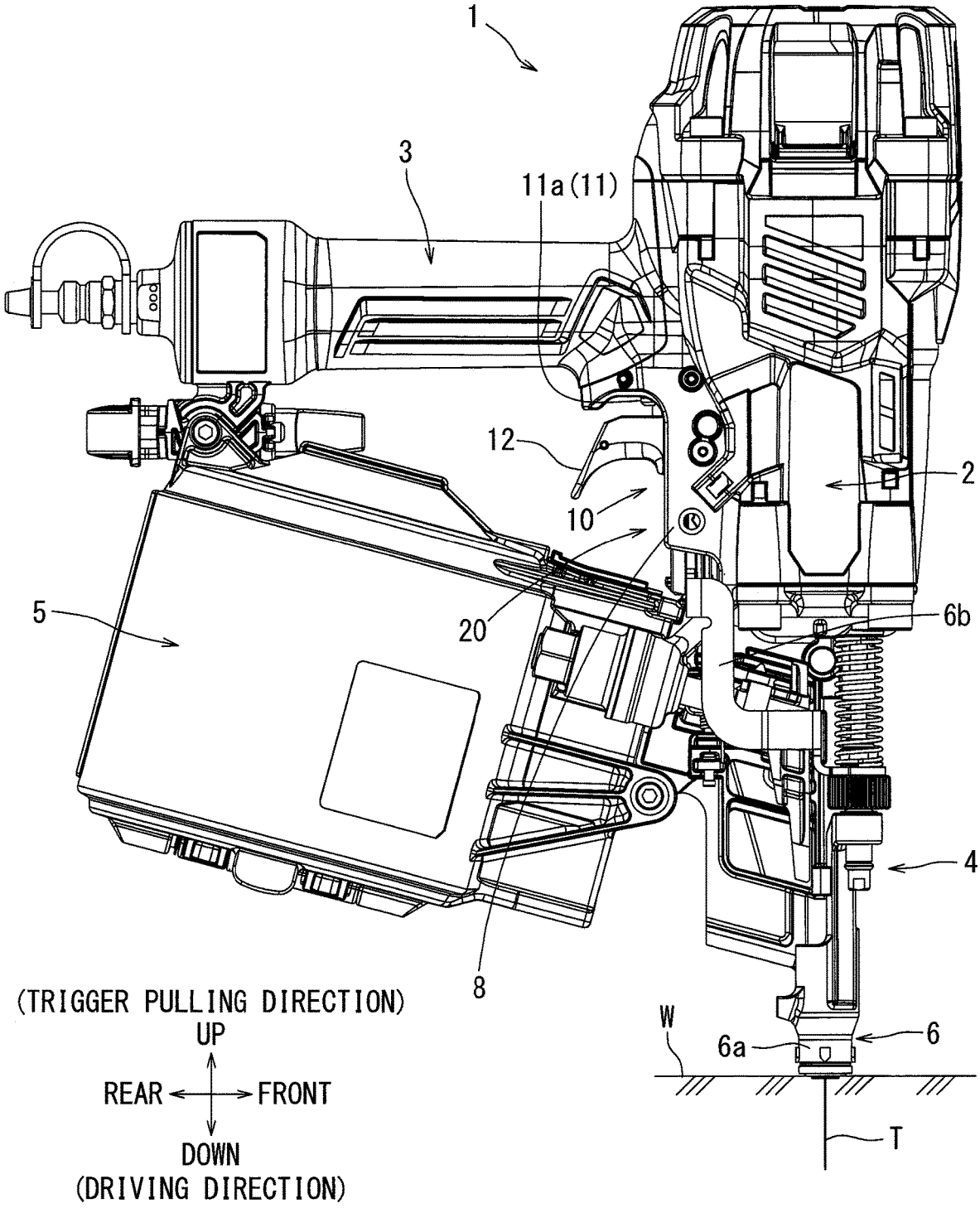
FIG. 2 is a right side view of the driving tool according to the exemplary embodiment.
Figure 3:
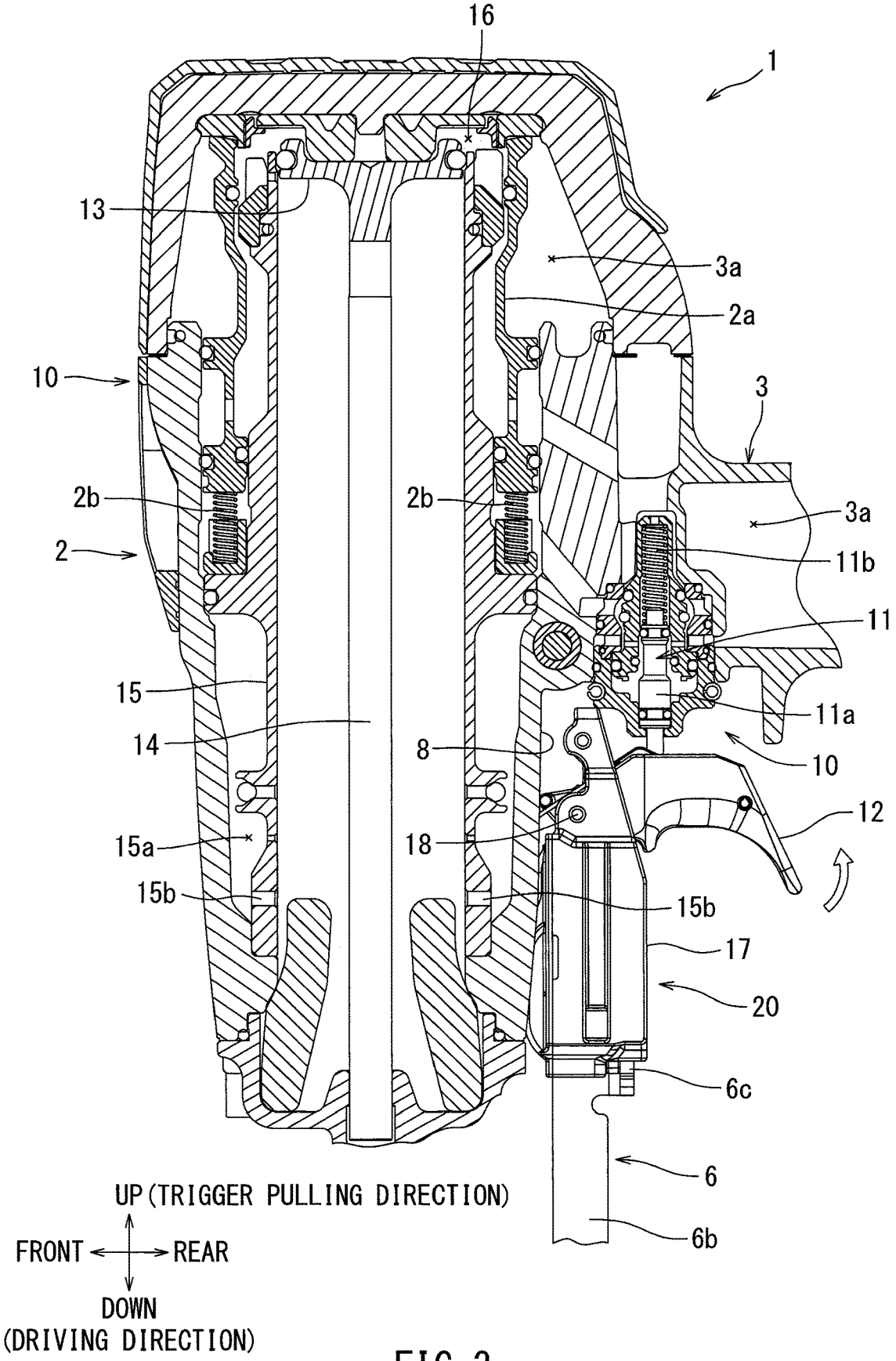
FIG. 3 is a longitudinal cross-sectional view of a tool main body of the driving tool.

Next, an embodiment of the present disclosure will be explained with reference to FIGS. 1 to 20. As shown in FIGS. 1 to 3, the present embodiment may exemplify a compressed-air-driven nail gun as an example of a driving tool 1. The driving tool 1 may include a tool main body 2, in which an internally mounted piston 13 may be reciprocated by compressed air. The driving tool 1 may also include a grip 3 that protrudes from a lateral part of the tool main body 2 in a lateral direction.

The driving tool 1 may also include a nose part 4 that extends from a lower part of the tool main body 2 in a downward direction. The driving tool 1 may also include a magazine 5 that straddles a space between the nose part 4 and the grip 3. A plurality of driving members T may be loaded within the magazine 5. The plurality of driving members T may be temporarily mounted parallel to each other in a wound coupling strip. The coupling strip may be fed to a side of the driving nose 4 in accordance with a driving operation of the tool main body 2. In this way, each driving member T may be supplied to the driving nose 4.

In the following explanations, a driving direction in which a driving member T is driven may be referred to as a downward direction, and a direction opposite to the driving direction may be referred to as an upward direction. A user holding the driving tool 1 may be situated at a rear side of the driving tool 1 (on a right side of the sheet in FIG. 1). A side of the user may be referred to as a rear side, and a side opposite to the rear side may be referred to as a front side. Left and right directions may be based on the user's position.

As shown in FIGS. 1 and 2, at a downward tip end of the driving nose 4, a contact arm 6 may be supported so as to move relative to the driving tool 1 in an up-down direction. One of the operations for performing a driving operation may include the relative movement of the contact arm 6 in the upward direction due to the contact arm 6 being pushed toward a workpiece W. The contact arm 6 may extend from near the tip end of the driving nose 4 to near the location of the trigger 12. At a lower portion of the contact arm 6, an annular-shaped contact portion **6*a* may be located around an ejection opening at the tip of the driving nose 4. As shown in FIG. 2, a band-plate-shaped extension portion 6*b* may be combined with the contact portion 6*a*. The extension portion 6*b* may extend upward. As shown in FIG. 3, an actuation portion 6*c* may be disposed at an upper part of the extension portion 6*b*. The actuation portion 6*c* may extend to a position near a lower location of the trigger 12. The contact arm 6, which may integrally include the contact portion 6*a*, the extension portion 6*b*, and the actuation portion 6*c*, may be supported so as to be moved in the up-down direction within a predetermined length along the driving nose 4**.

As shown in FIG. 3, a starting device 10 according to the present embodiment may be disposed at a lateral part of the tool main body 2 near a base of the grip 3. A starting valve 11 may be turned on by a starting operation of the starting device 10. When the starting valve 11 is turned on, compressed air may be supplied to an upper piston chamber 16 of the tool main body 2. When the compressed air is supplied to the upper piston chamber 16, a piston 13 may move downward in a cylinder 15. A long rod-shaped driver 14 may be attached to a lower surface of the piston 13. By the downward movement of the piston 13, and in turn the movement of the driver 14 within the driving nose 4 (a driving passage), one driving member T may be driven out of the tip end (the ejection opening) of the driving nose 4. The driving member T may be supplied one by one from the magazine 5 to the driving nose 4 in accordance with a driving operation of the tool main body 2.

As shown in FIG. 1, a trigger lock lever 7 may be disposed on a lateral side of the starting device 10. When the trigger lock lever 7 is rotated downward as shown in FIG. 1, the trigger 12 can be pulled in an upward direction. On the other hand, when the trigger lock lever 7 is rotated by approximately 90° in a counterclockwise direction (in an upward direction), the trigger is in a trigger lock state and therefore cannot be pulled in the upward direction. As a result of preventing an unintentional pulling operation of the trigger, an inadvertent driving operation of the driving tool 1 can be prevented due to placing the trigger lock lever 7 at the upper side lock position.

The starting device 10 according to the present embodiment may have unconventional features. Certain features may be know with respect to the basic configurations of the driving tool 1 of the present embodiment, and thus certain detailed explanations may be omitted. The starting valve 11 may have a feature that the starting valve 11 can be on-operated on the condition that both the single or continuous on-operation of the trigger 12 and the single or continuous on-operation of the contact arm 6 has been performed, the various timing and/or ordering of the on-operations being based on the operation mode of the driving tool 1. The starting device 10 of the present embodiment may include the above-described starting valve 11, the above-described trigger 12, and a timer mechanism 20. As shown in FIG. 3, the starting valve 11 may be housed on the lower side of the base of the grip 3. A lower portion of the valve stem 11*a* may protrude toward the trigger 12. The valve stem 11*a* of the starting valve 11 may be supported so as to be movable in the up-down direction (e.g., toward the on-position and off-position). The valve stem 11*a* may be biased downward toward the off-position by a compression spring 11*b*. FIG. 3 shows that the valve stem 11*a* is disposed at the off-position. When the valve stem 11*a* is moved from the off-position toward the upward direction against the spring biasing force, the starting valve 11 may be turned on.

When the starting valve 11 is turned on, a head valve 2*a* may be moved downward, so as to be opened, by the air pressure applied in the downward direction. When the head valve 2*a* is open, the compressed air that has accumulated in an accumulation chamber 3*a* in the grip 3 may be supplied to a piston upper chamber 16. When the valve stem 11*a* is returned to its initial position by moving in the downward direction by the spring biasing force, the starting valve 11 may be turned off. When the starting valve 11 is turned off, the head valve 2*a* may be moved upward by both the spring force and the air pressure applied in the upward direction. Because of this, the piston upper chamber 16 may be closed with respect to the accumulation chamber 3*a*. When the piston upper chamber 16 is closed with respect to the accumulation chamber 3*a*, the piston upper chamber 16 may be open to the atmosphere. Furthermore, the compressed air flowing into a return-air chamber 15*a* through a vent hole 15*b* may be applied to a lower surface of the piston 13 that has moved downward. Thereby, the piston 13 may be returned to an upper dead center (e.g. the initial position).

As discussed above, in order to start a driving operation of the tool main body 2 (e.g., in order to move the valve stem 11*a* of the starting valve 11 to the on-position), both the on-operation of the trigger 12 (movement to an on-position of the trigger 12) and the on-operation of the contact arm 6 (movement to an on-position of the contact arm 6) may be required. When the contact arm 6 is on-operated at first and then the trigger 12 is on-operated, a so-called single driving (focused driving) may be performed. In contrast, when the trigger 12 is on-operated at first while the contact arm 6 is still at an off-position and then the contact arm 6 is on-operated within a predetermined time period t from the trigger 12 being on-operated, a driving operation may be performed. In this case, a so-called continuous driving (swung driving) may be performed by repeating an on-operation of the contact arm 6 within the predetermined time period t while the trigger 12 is kept at an on-position. In some embodiments, the predetermined time period t may be partially or entirely reset with each on/off operation of the contact arm 6 while the trigger is kept at the on-position. In the continuous driving case, the predetermined time period t within which the contact arm 6 is allowed to be on-operated after the trigger 12 is on-operated may be set by a time mechanism 20, which will be explained in detail below. An on-operation of the contact arm 6 may be prohibited (locked) after the predetermined time period t has passed. The timer mechanism 20 may be reset when the on-operation of the trigger 12 is released or other suitable means.

Figure 6:
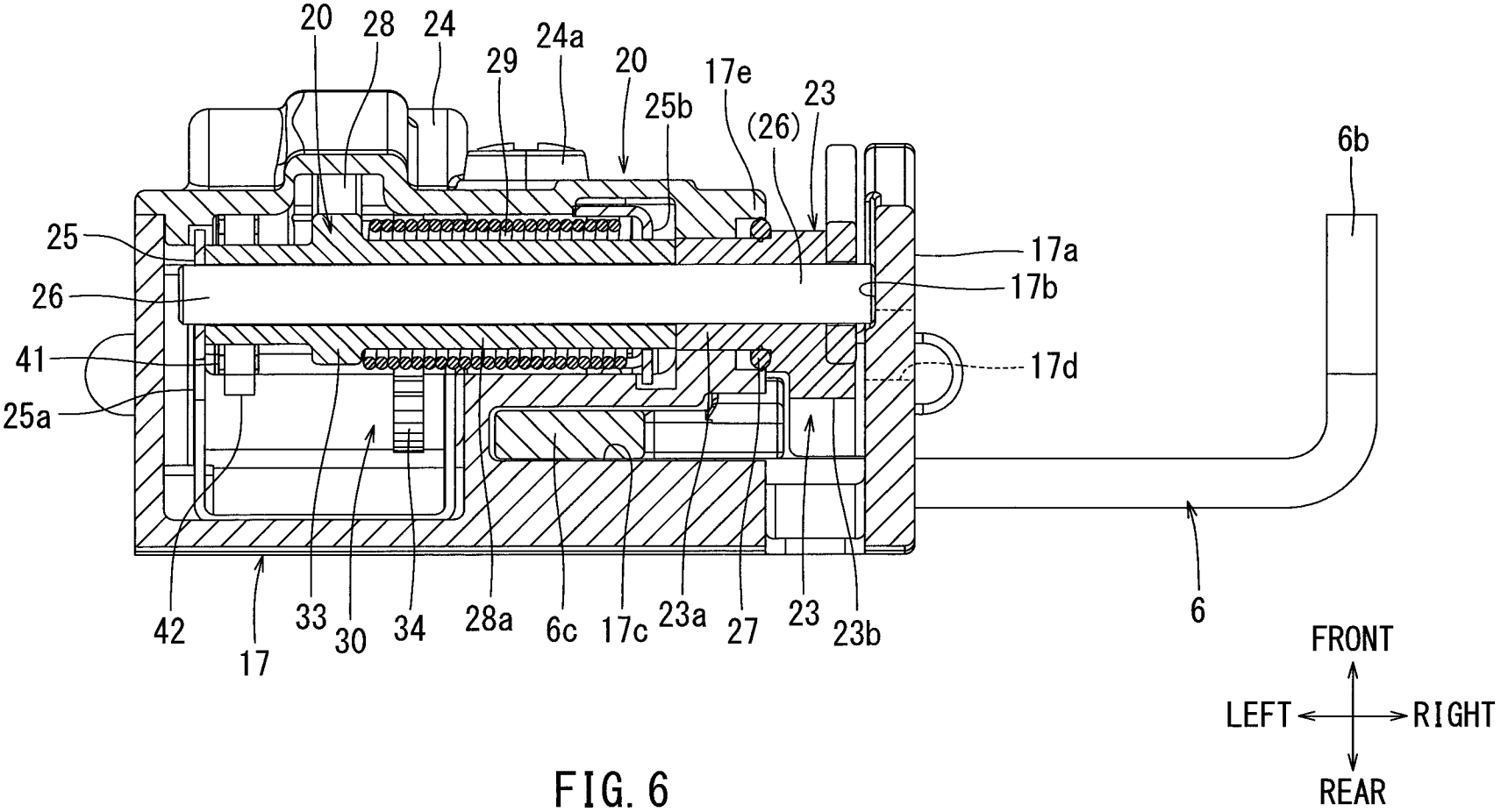
FIG. 6 is a cross-sectional view taken along line VI-VI of FIG. 5.
Figure 7:
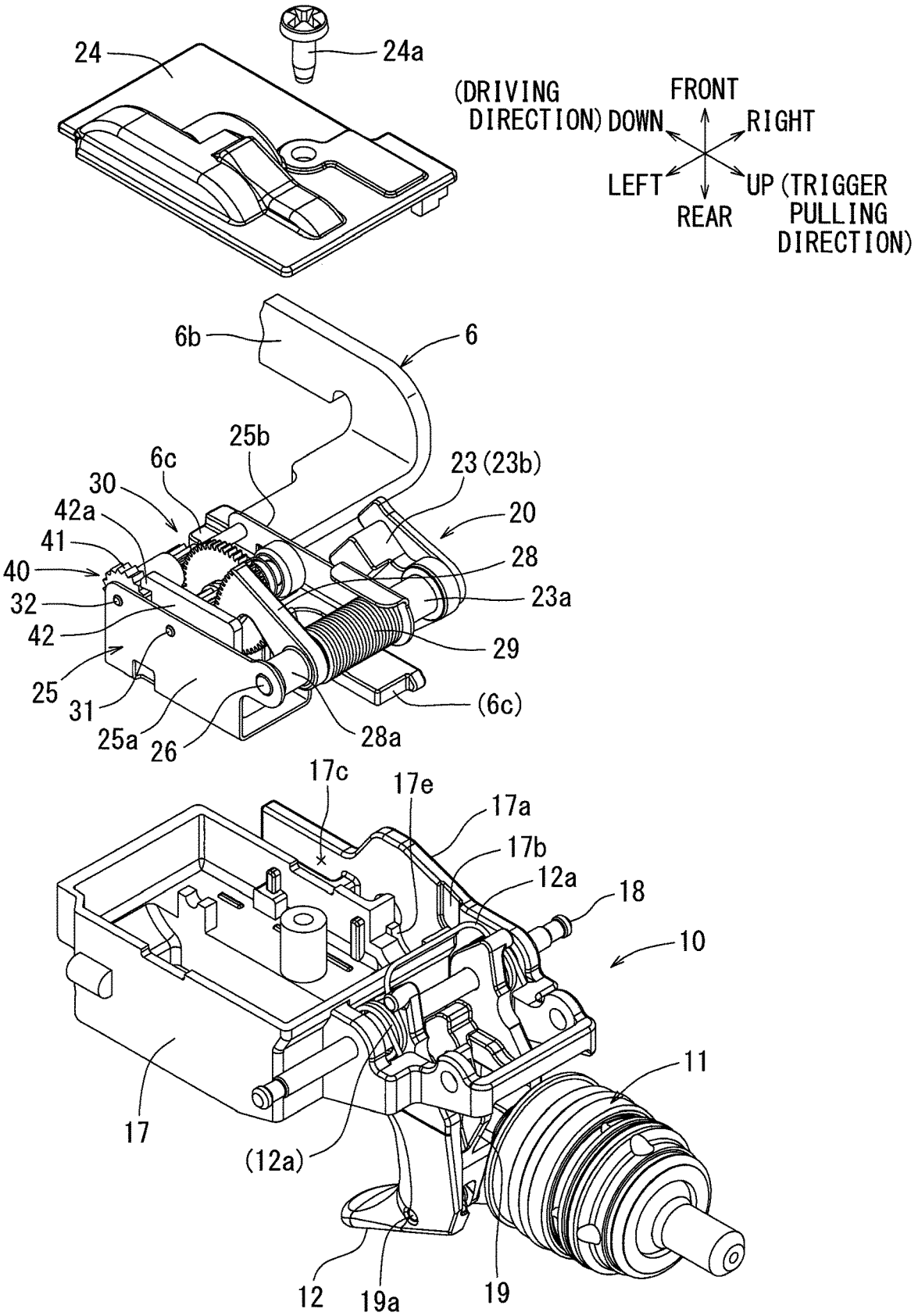
FIG. 7 is an exploded perspective view of the timer mechanism.
Figure 13:
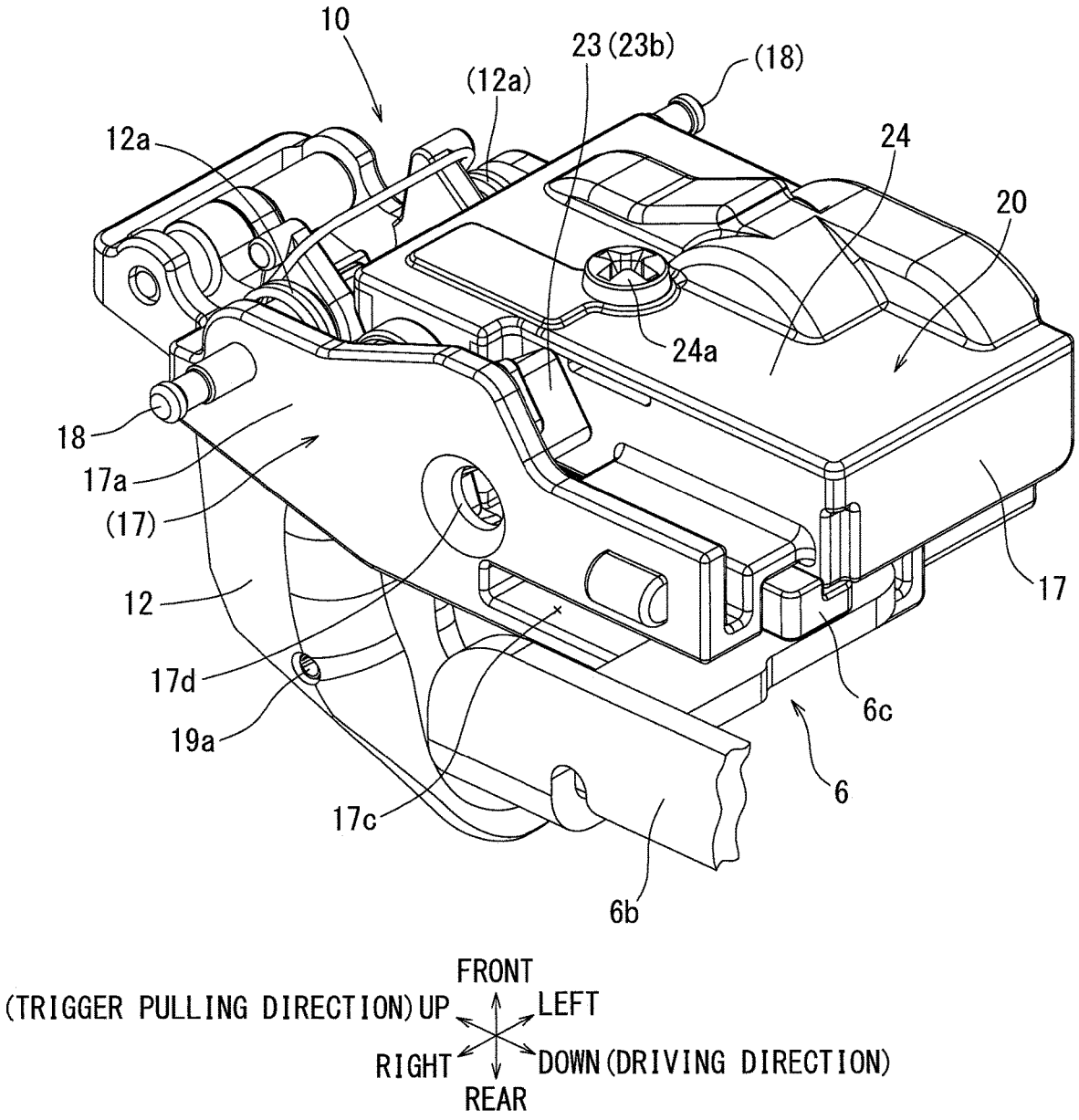
FIG. 13 is a perspective view of the timer mechanism, which is obliquely viewed from the lower-right in a direction indicated by an arrow XIII in FIG. 4. This figure shows that the contact restriction member is at the unlock position and the contact restriction member cannot be seen through a window.
Figure 14:
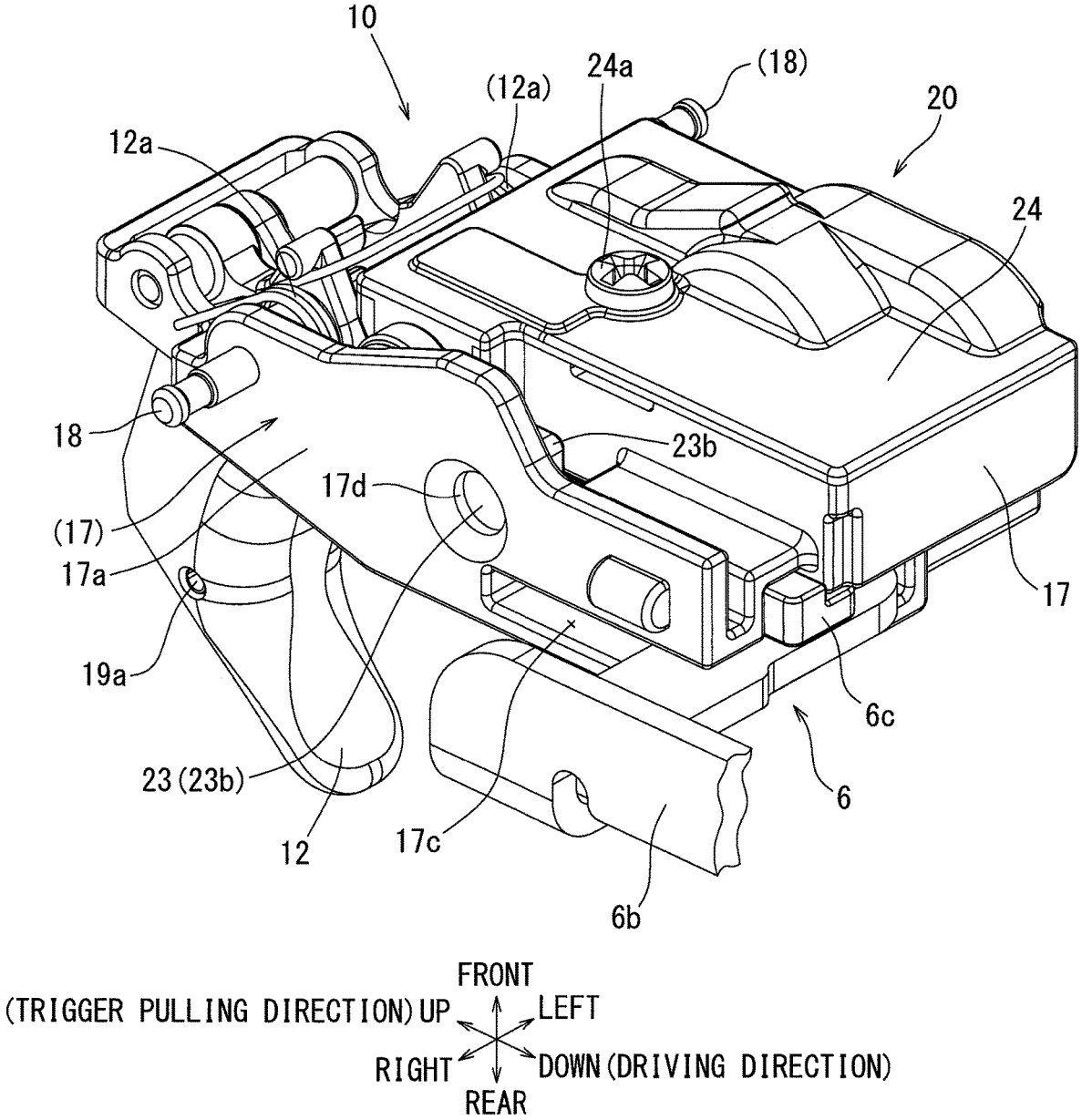
FIG. 14 is a perspective view of the timer mechanism, which is obliquely viewed from the lower-right. This figure shows that the contact restriction member is at a lock position and the contact restriction member can be seen through the window.

FIGS. 3 to 7 show a detailed embodiment of the starting device 10. As shown in FIG. 3, the starting device 10 may be supported by a seat 8 disposed on a rear side of the tool main body 2. The starting device 10 may include the trigger 12 and the timer mechanism 20. The trigger 12 and the timer mechanism 20 may be supported by a mechanism case 17. As shown in FIG. 3, the mechanism case 17 may be connected to the seat 8. As shown in FIGS. 7, 13 and 14, a shield wall member 17*a* for shielding a contact restriction member 23 from other members may be disposed at the right of the mechanism case 17. The shield wall member 17*a* may prevent the other members from interfering with or damaging the contact restriction member 23. Because of this configuration, an operation failure of the timer mechanism 20 may be prevented. Furthermore, the contact restriction member 23 may be kept free of dust by the shield wall member 17*a*. Because of this, an operation failure of the contact restriction member 23 may be further prevented. A guide groove 17*c* may be provided in the mechanism case 17 along the shield wall member 17*a*. The guide groove 17*c* may guide the actuation portion 6*c* of the contact arm 6 in the up-down direction. The contact arm 6 may be on-operated when the actuation portion 6*c* of the contact arm 6 is sufficiently moved upward within the guide groove 17*c*.

As shown in FIG. 3, the trigger 12 may be supported above the mechanism case 17. The trigger 12 may be supported so as to be rotatable in the up-down direction around a support shaft 18. The trigger 12 may be pulled upward by a user's fingertip on the hand by which the grip 3 is being held. A position toward which the trigger 12 is pulled upward may correspond to an on-position of the trigger 12 (trigger on-position). The starting valve 11 may be on-operated when the trigger 12 is at the trigger on-position. The trigger 12 may be spring-biased in a downward direction by a torsion spring 12*a* so as to be rotated toward the side of a trigger off-position.

As shown in FIG. 7, an idler 19 may be supported on the upper surface side (on the back surface side) of the trigger 12 so as to be rotatable in the up-down direction around a support shaft 19*a*. The idler 19 may be spring-biased by a torsion spring (not shown in the figures) in a direction such that its rotation tip end (on the front side) is moved in the upward direction. The idler 19 may be pushed by the biasing force of the torsion spring to contact a tip end of the valve stem 11*a* at all times.

When the trigger 12 is pulled upward (to the trigger on-position) and then the contact arm 6 is on-operated by moving upward (to an arm-on position), the rotation tip end of the idler 19 may be pushed upward by the actuation portion 6*c* of the contact arm 6. Because of this movement, the valve stem 11*a* of the starting valve 11 may be pushed upward, thereby on-operating the starting valve 11. An upward position of the contact arm 6 at which the starting valve 11 is on-operated may correspond to the arm-on position of the contact arm 6. In another case, i.e., when the contact arm 6 is on-operated to the arm-on position before the trigger has been pulled, the support shaft 19*a* side of the idler 19 may not move upward, thereby preventing the starting valve 11 from being on-operated. After that, a pulling operation of the trigger 12 may cause the starting valve 11 to be on-operated, as the idler 19 is restricted from moving downward relative to the trigger 12. Furthermore, in another case, for example, when the trigger 12 is first pulled and the contact arm 6 is not on-operated, the rotation tip end of the idler 19 may not be pushed upward, thereby preventing the starting valve 11 from being on-operated. After that, if the contact arm 6 is on-operated within a predetermined time period t, the starting valve 11 may be on-operated, thereby performing a driving operation of the tool main body 2.

Figure 16:
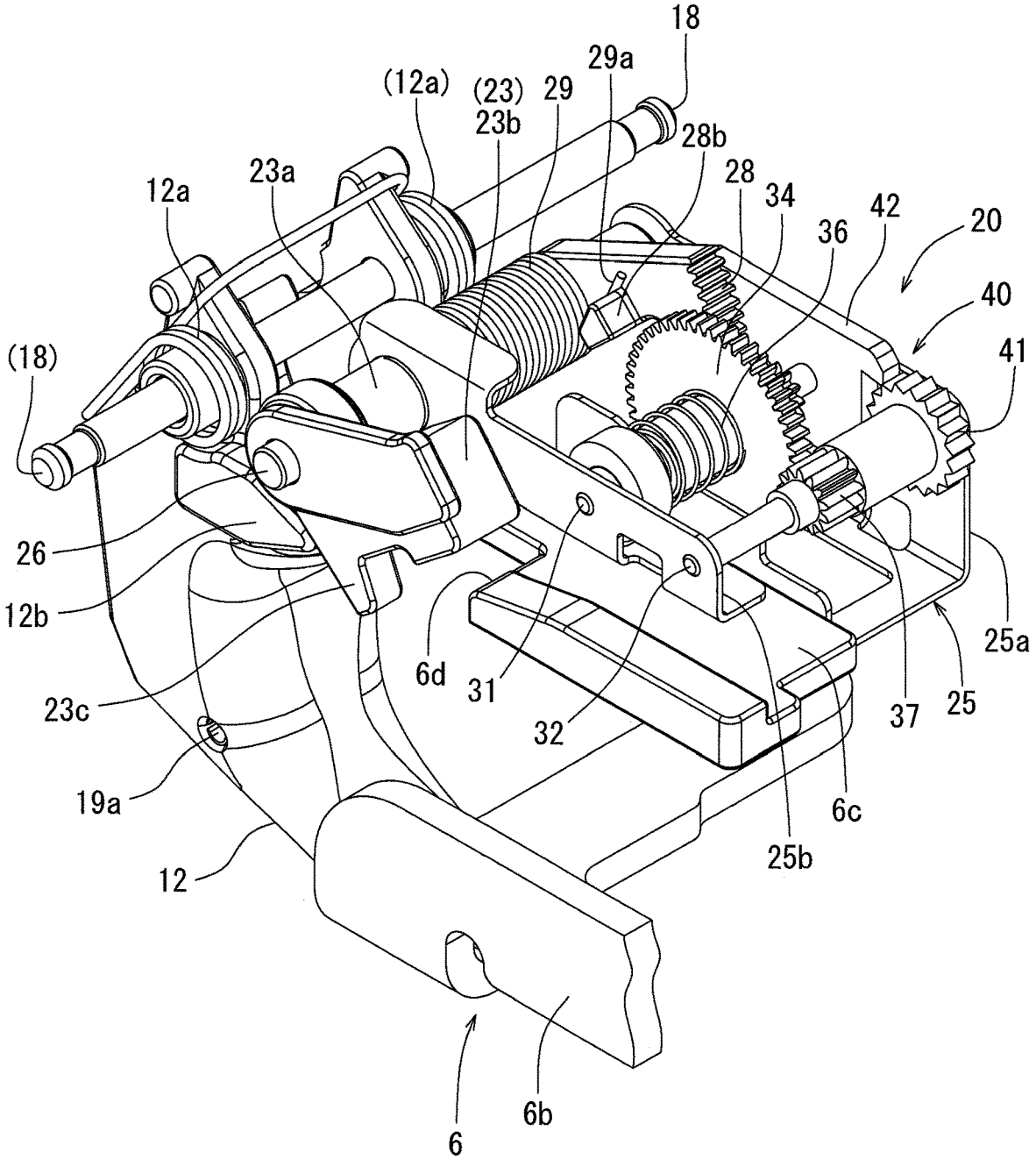
FIG. 16 is a perspective view of the timer mechanism, which is obliquely viewed from the lower-right. This figure shows the initial state of the starting device, in which the trigger is at the off-position and the contact arm is at the off-position.
Figure 16:
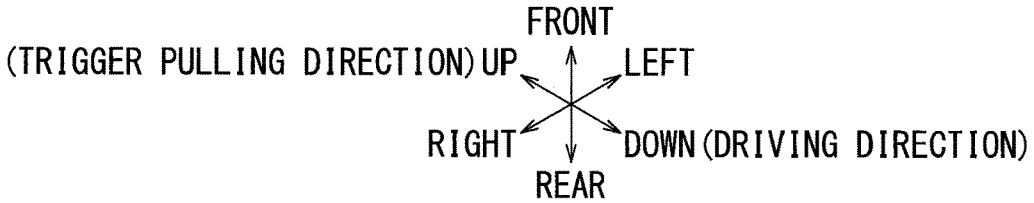

As shown in FIG. 16, the actuation portion 6*c* of the contact arm 6 may include a lock portion 6*d* that selectively engages the contact restriction member 23, which is discussed later. The lock portion 6*d* may be formed in a stepped shape at a middle of the actuation portion 6*c* in its longitudinal direction, although other configurations are possible. As discussed later, when the contact restriction member 23 is situated just above the lock portion 6*d*, the contact arm 6 may be restricted from being on-operated, thereby prohibiting a driving operation of the tool main body 2. In contrast, when the contact restriction member 23 retreats frontward from the lock portion 6*d*, the actuation portion 6*c* may be allowed to move upward, thereby allowing the actuation portion 6*c* to be on-operated.

Figure 4:
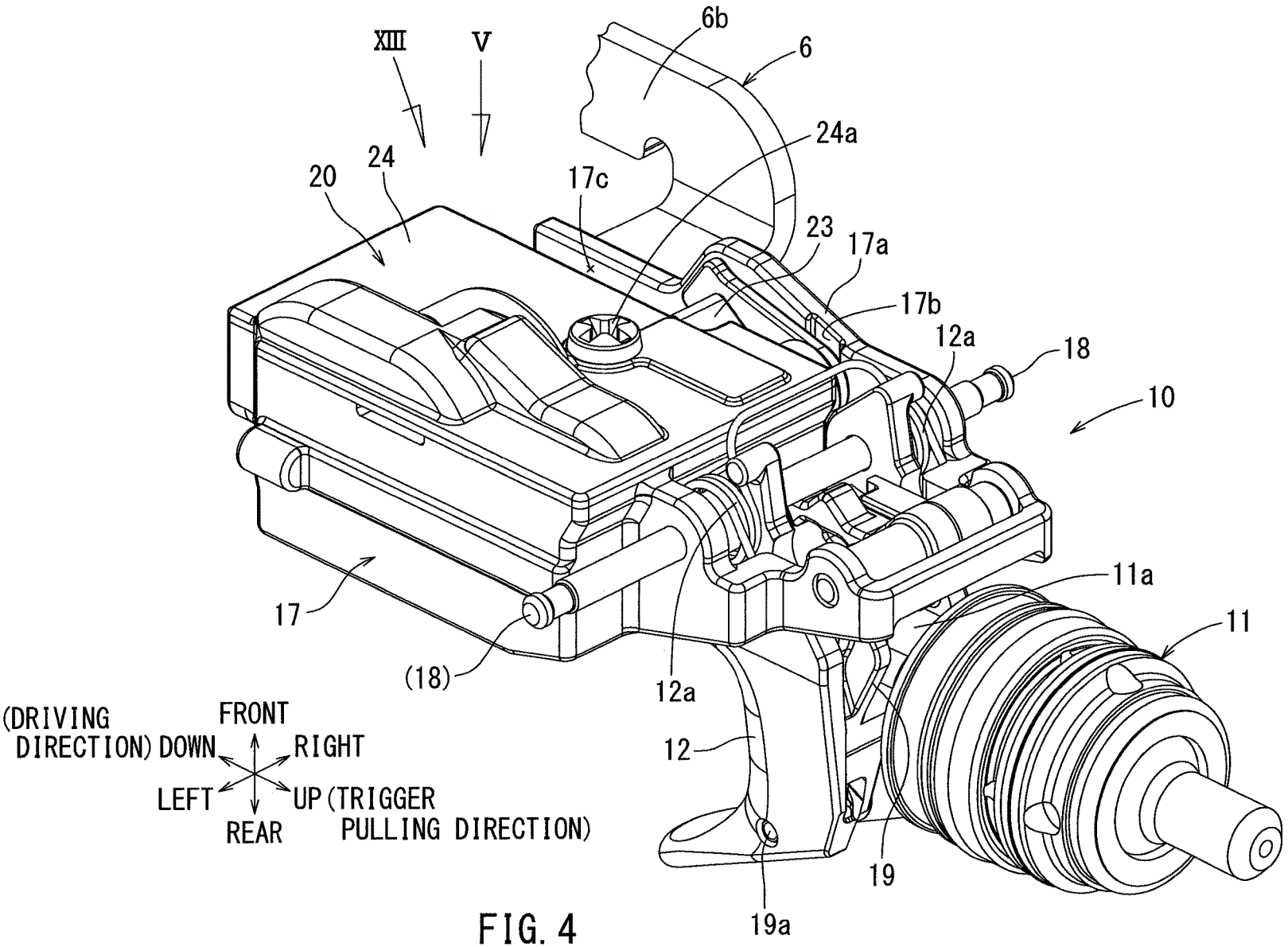
FIG. 4 is a perspective view of a timer mechanism.
Figure 5:
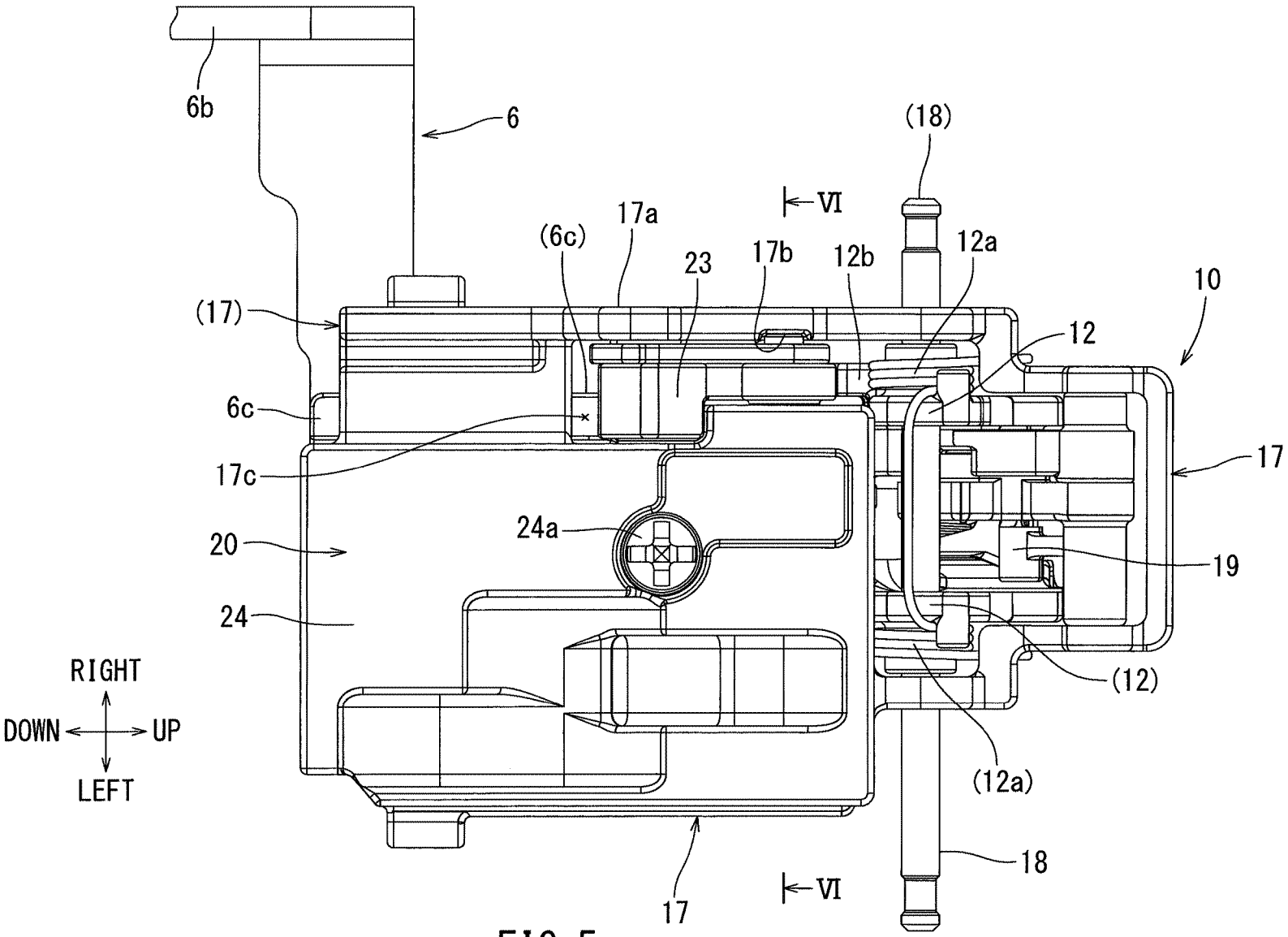
FIG. 5 is a front view of the timer mechanism, which is viewed in a direction indicated by an arrow V in FIG. 4.

As shown in, for example, FIG. 3, the timer mechanism 20 may be arranged below the trigger 12. The timer mechanism 20 may specify the above-described predetermined time period t. As shown in, for example, FIG. 7, the timer mechanism 20 may include the contact restriction member 23, a plurality of stages of a gear train 30, and an intermittent rotation mechanism 40. As shown in FIGS. 4 and 7, the gear train 30 and the intermittent rotation mechanism 40 may be housed in the mechanism case 17. The mechanism case 17 may have a rectangular box shape open to the front. A cover 24 may cover the front opening of the mechanism case 17. The cover 24 may be fixed to the mechanism case 17 by a fixation screw 24*a*. A dustproof property of the gear train 30 and the intermittent rotation mechanism 40 may be provided by the mechanism case 17 covered by the cover 24. The contact restriction member 23 may not be covered by the cover 24. Accordingly, the contact restriction member 23 may be arranged outside the sealed mechanism case 17.

Figure 8:
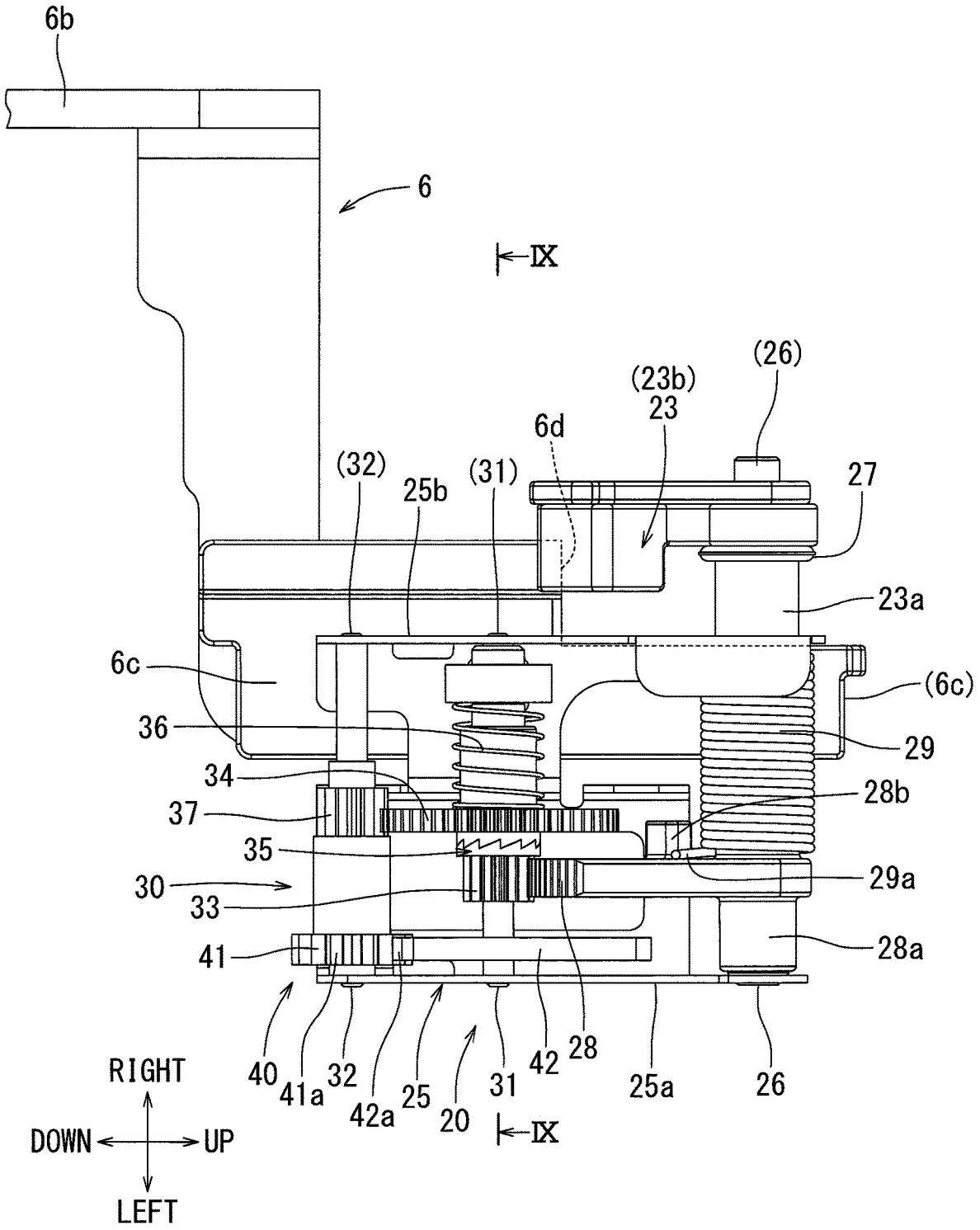
FIG. 8 is a front view of a portion of the timer mechanism.
Figure 9:
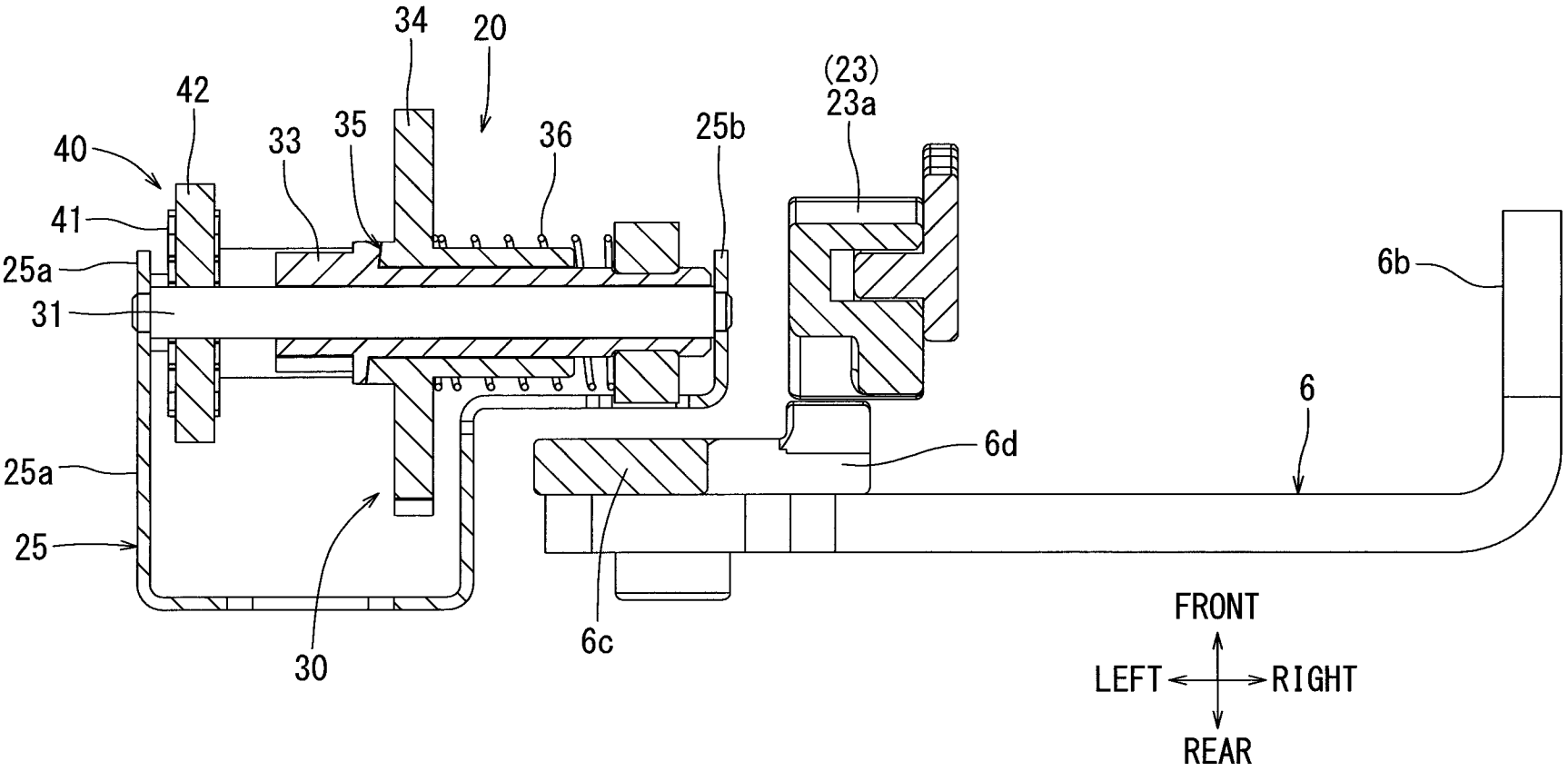
FIG. 9 is a cross-sectional view taken along line IX-IX of FIG. 8.

As shown in FIGS. 7 and 8, the contact restriction member 23, the gear train 30, and the intermittent rotation mechanism 40 may be assembled in a gear train base 25. The gear train 30 and the intermittent rotation mechanism 40 may be housed in the mechanism case 17 with the gear train 30 and the intermittent rotation mechanism 40 being assembled. The gear train base 25 may be formed by a working a steel plate, such as by punching, bending, etc. The contact restriction member 23 may be supported on the right side of the gear train base 25, so as to be rotatable in the up-down direction around a support shaft 26. A left end portion of the support shaft 26 may be supported by a left side wall 25*a* of the gear train base 25. A right end portion of the support shaft 26 may be supported by a retention recess 17*b* formed in the shield wall member 17*a* of the mechanism case 17. As shown in FIG. 7, the retention recess 17*b* may be open in a front-rear direction. The assembled contact restriction member 23, the gear train 30, and the intermittent rotation mechanism 40 may be installed in the mechanism case 17 by inserting the right end portion of the support shaft 26 into the retention recess 17*b* from the front. Because of this configuration, assembling workability may be improved. Furthermore, since the contact restriction member 23, the gear train 30, and the intermittent rotation mechanism 40 are assembled and installed in the mechanism case 17, it may not be necessary to substantially modify the tool main body 2 for an application of the exemplified timer mechanism 20.

As shown in FIGS. 4, 7, and 8, the contact restriction member 23 may include a cylindrical-shaped support portion 23*a* and a restriction portion 23*b*. The restriction portion 23*b* may protrude in a radial direction from a right end of the support portion 23*a*. The support portion 23*a* may pass through a right side wall 17*e* of the mechanism case 17 to project to the outside thereof. The restriction portion 23*b* may be integrally formed on a side of the protruding end portion of the support portion 23*a*. As shown in FIG. 6, a seal member 27 may be inserted between the support portion 23*a* and the right side wall 17*e* of the mechanism case 17. Because of the presence of the seal member 27, the sealing property (dustproof property) of the mechanism case 17 with regard to the contact restriction member 23 may be provided.

Figure 10:
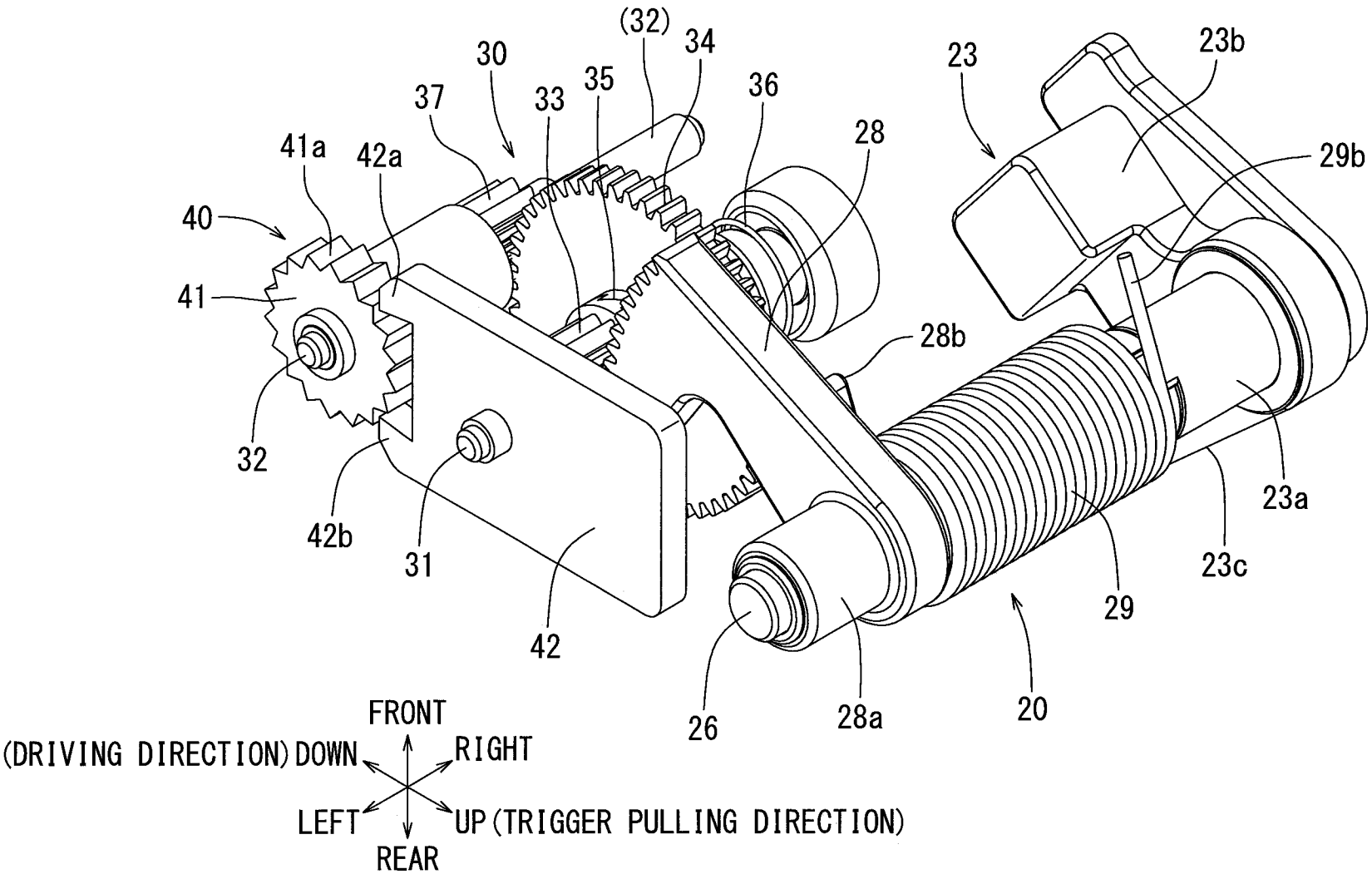
FIG. 10 is a perspective view of a part of the timer mechanism, showing an initial state in which a contact restriction member is at an unlock position.

As shown in FIG. 10, a first gear 28 may be supported on a left side of the support shaft 26. A cylindrical-shaped support portion 28*a* may be formed integrally with the first gear 28. The first gear 28 may be supported so as to be rotatable in the front-rear direction around the support shaft 26. A torsion spring 29 may be inserted around the support portion 28*a*. As shown in FIGS. 8 and 16-18, one end 29*a* of the torsion spring 29 may engage a spring engagement portion 28*b* formed on the right side of the first gear 28. The other end 29*b* (shown in FIG. 10) of the torsion spring 29 may engage the gear train base 25, though the actual engagement location of the gear train base 25 with the other end 29*b* of the torsion spring 29 may not be shown in the figures. The first gear 28 may be spring biased by the torsion spring 29 in a direction in which the first gear 28 rotates rearward (counterclockwise direction as seen from the left side view in FIG. 10).

The support portion 28*a* of the first gear 28 and the support portion 23*a* of the contact restriction member 23 may be rotatably integrated with each other. Because of this configuration, both the first gear 28 and the contact restriction member 23 may be spring biased by the torsion spring 29 in a direction to rotate rearward (a contact lock side). In other words, the contact restriction member 23 may be spring biased by the torsion spring 29 in a direction to move to a lock position, such that the actuation portion 6*c* of the contact arm 6 is restricted from moving to an on-position.

Figure 17:
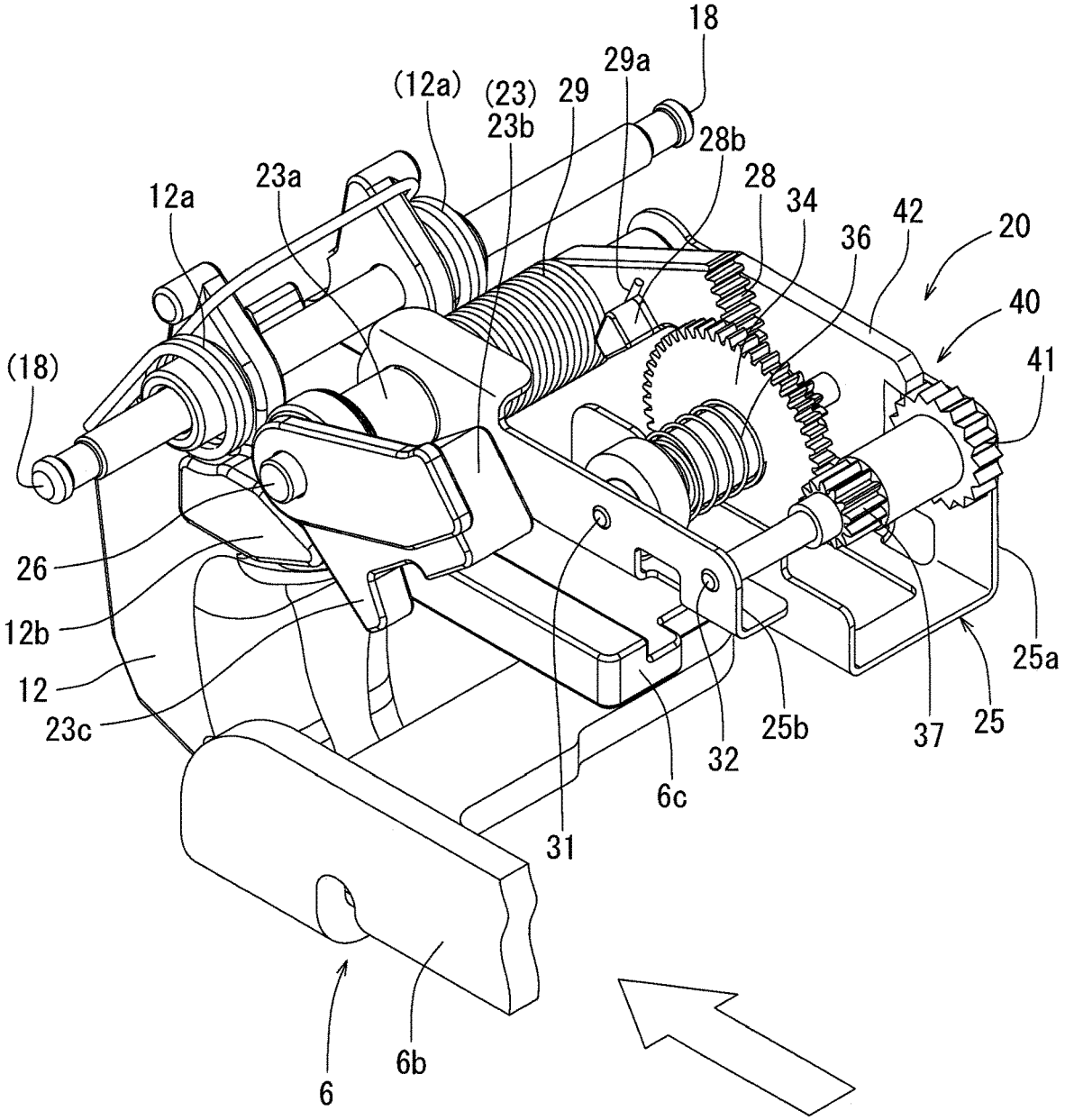
FIG. 17 is a perspective view of the timer mechanism, which is obliquely viewed from the lower-right. This figure shows that the trigger is at the off-position and the contact arm is at an on-position.
Figure 17:
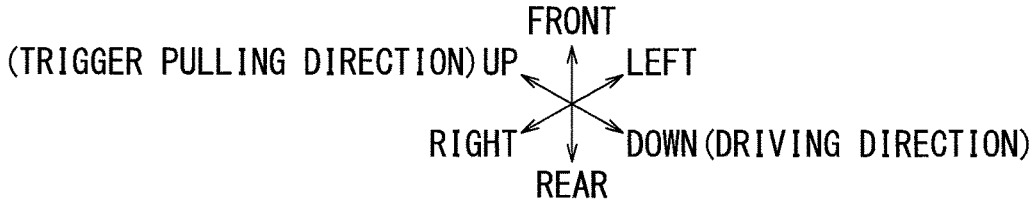

As shown in FIGS. 16 and 17, a restriction release portion 12*b* may be formed integrally with the trigger 12 on the front side (rotation support side) of the trigger 12. When the trigger 12 is located at an off-position (on a lower side) by the biasing force of the torsion spring 12*a*, the restriction release portion 12*b* may engage a release receiving portion 23*c* of the contact restriction member 23. Because of this configuration, the contact restriction member 23 may be retained at an unlock position (on a front side) against the torsion spring 29. In other words, the contact restriction member 23 may be pushed and/or held frontward in FIGS. 16 and 17. When the contact restriction member 23 is at the unlock position, the contact arm 6 may be allowed to move to an arm-on position, e.g., the contact arm 6 may be allowed to be on-operated.

Figure 19:
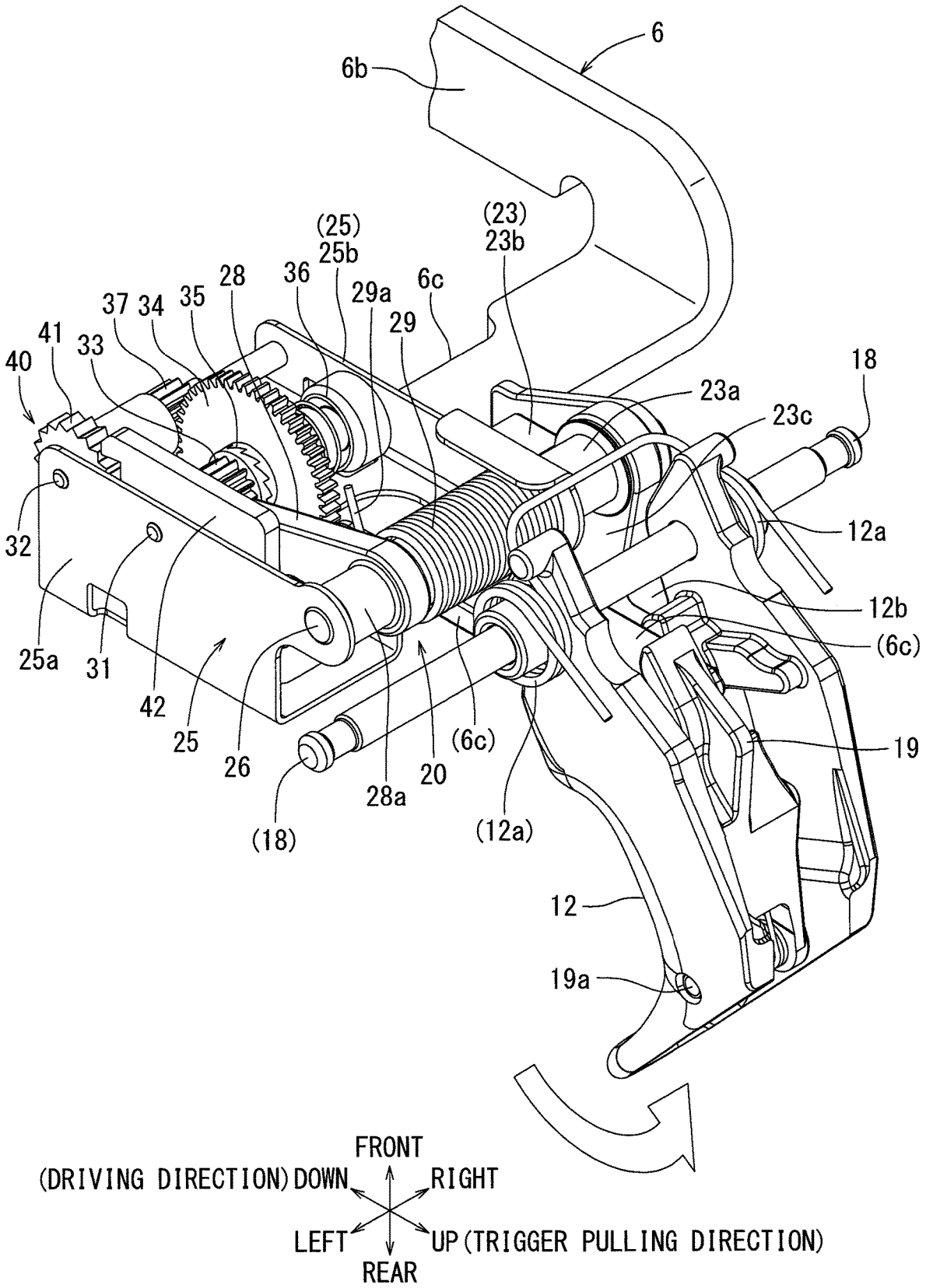
FIG. 19 is a perspective view of the timer mechanism, which is obliquely viewed from the upper-left. This figure shows that the trigger is at the on-position and the contact arm is in a lock state, in which an on-operation of the contact arm is restricted.
Figure 20:
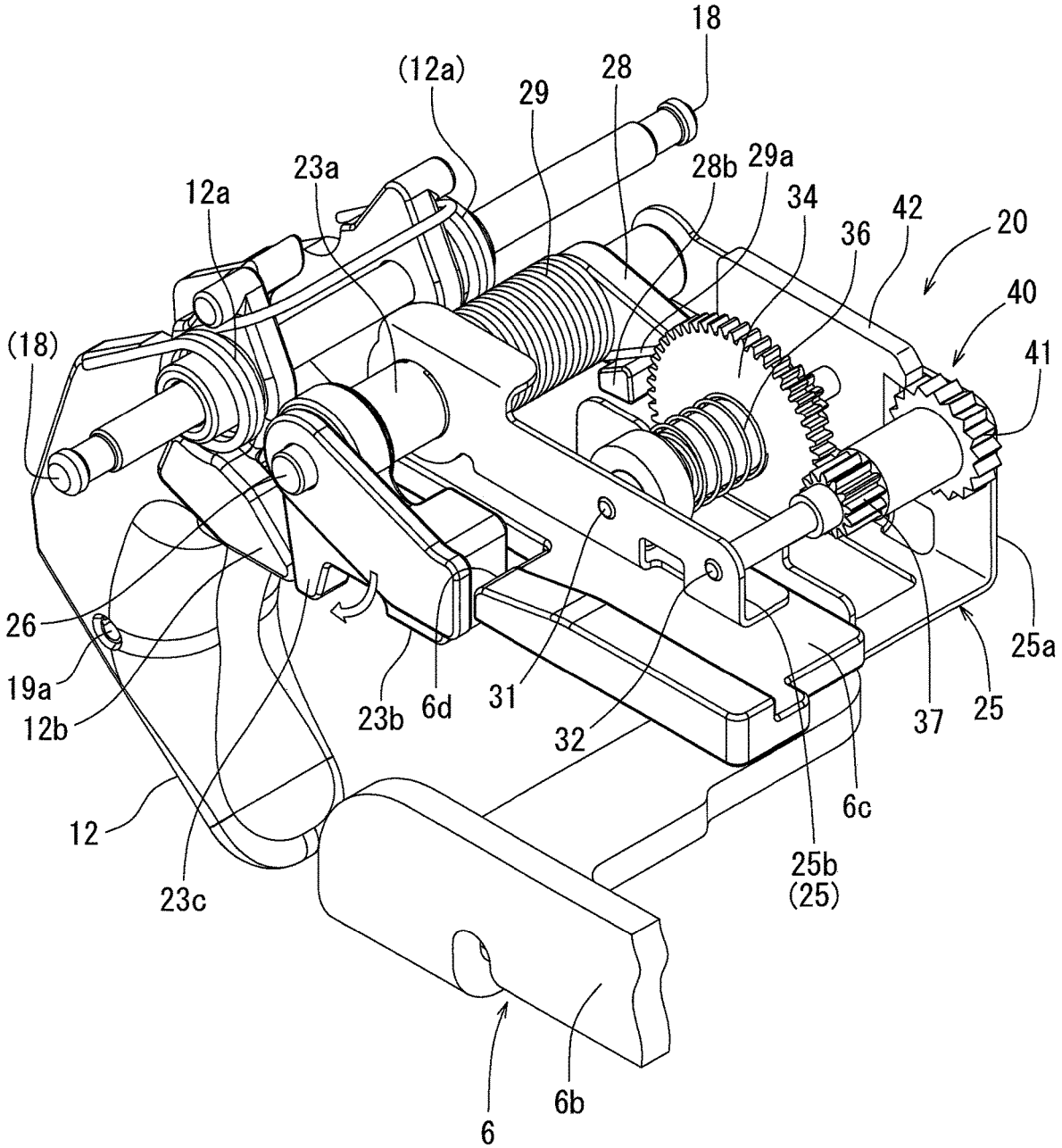
FIG. 20 is a perspective view of the timer mechanism, which is obliquely viewed from the lower-right. This figure shows that the trigger is at the on-position and the contact arm is in the lock state, in which an on-operation of the contact arm is restricted.
Figure 20:
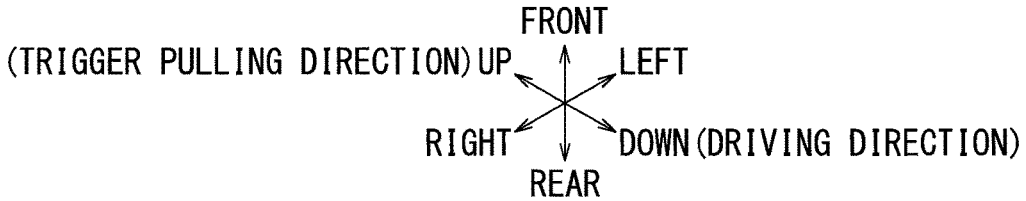

In contrast, when the trigger 12 is pulled to an on-position (on-operated), an embodiment of the direction of which is indicated by a void arrow in FIG. 19, the restriction release portion 12*b* may retreat rearward, thereby allowing the contact restriction member 23 to rotate rearward (lock side)

due to the biasing force of the torsion spring 29, an embodiment of the direction of which is indicated by a void arrow in FIG. 20. When the contact restriction member 23 moves to the lock position, the restriction portion 23*b* may be in a position that it can make contact with the lock portion 6*d*, thereby restricting the contact arm 6 from moving to the arm-on position. The predetermined time period t during which the contact restriction member 23 is moved from the unlock position to the lock position after the trigger 12 has been on-operated may be specified by the timer mechanism 20, an embodiment of which will be discussed below.

Figure 15:
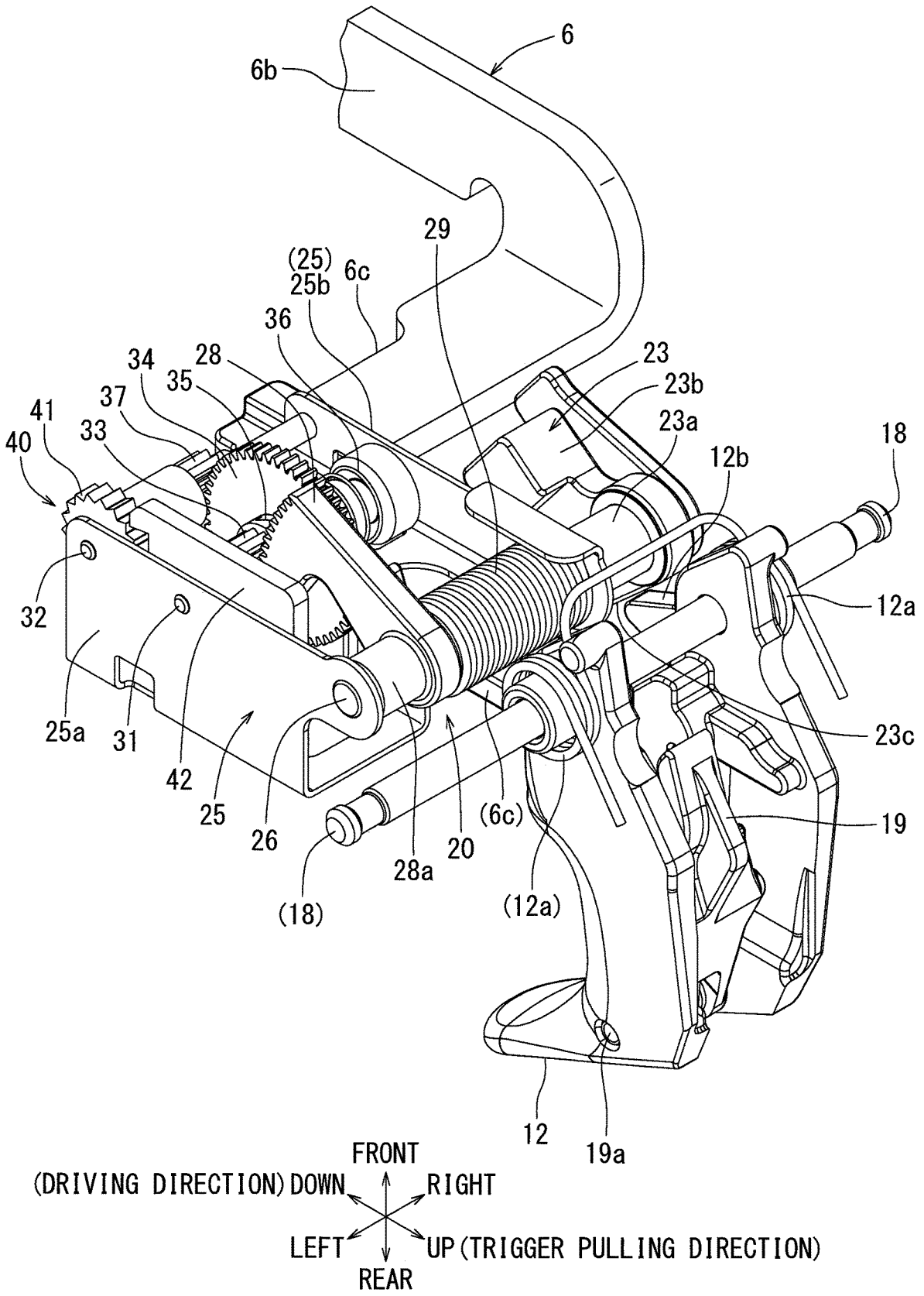
FIG. 15 is a perspective view of the timer mechanism, which is obliquely viewed from the upper-left. This figure shows an initial state of a starting device, in which a trigger is at an off-position and a contact arm is at an off-position.

As shown in FIGS. 8, 10, and 15, the contact restriction member 23 may be linked to the plurality of stages of a gear train 30 via a first gear 28. Rotation of the first gear 28 may be transferred to the intermittent rotation mechanism 40 by the gear train 30. The gear train 30 may be configured such that the rotational speed is increased. Because of this configuration, a rotational speed of a restriction wheel 41 of the intermittent rotation mechanism 40 may be faster than that of the first gear 28.

As shown in FIG. 8, a first train shaft 31 and a second train shaft 32 may be disposed parallel to each other. The first train shaft 31 and the second train shaft 32 may both extend from the left side wall 25*a* to a right side wall 25*b* of the gear train base 25. The second train shaft 32 may be disposed below the first train shaft 31. A second gear 33 may be rotatably supported in the middle of the first train shaft 31. The second gear 33 may engage the first gear 28. The second gear 33 may be a spur gear having a diameter smaller than that of the first gear 28.

A third gear 34 may be disposed coaxial to the second gear 33 and on the right side of the second gear 33. The second gear 33 and the third gear 34 may be supported so as to be independently rotatable with respect to each other. An engagement-type clutch mechanism 35 may be disposed between the second gear 33 and the third gear 34. A one-way clutch may be used for the clutch mechanism 35. When the clutch mechanism 35 is in an engagement state, the second gear 33 and the third gear 34 may integrally rotate together with each other. The clutch mechanism 35 may be biased in an engagement direction by a compression spring 36. When the clutch mechanism 35 is in a disengagement state against a force of the compression spring 36, a power transmission path between the second gear 33 and the third gear 34 may be disconnected. For example, an intermittent rotation movement due to the gear train 30 and the restriction wheel 41 may not be performed. Because a rotational movement of the contact restriction member 23 is disconnectable from the intermittent movement of the restriction wheel 41 and the gear train 30, the rotational movement of the contact restriction member 23 from the lock side to an unlock side may be performed rapidly. Accordingly, the trigger 12 may be rapidly returned to an off-position.

As shown in FIG. 8, the third gear 34 may be a spur gear having a diameter larger than that of the second gear 33. The third gear 34 may engage a fourth gear 37. The fourth gear 37 may be a spur gear having a diameter smaller than that of the third gear 34. The fourth gear 37 may be rotatably supported by the gear train base 25 via the second train shaft 32. The restriction wheel 41 of the intermittent rotation mechanism 40 may be rotatably supported on the left side of the fourth gear 37 by the gear train base 25 via the second train shaft 32. The fourth gear 37 and the restriction wheel 41 may integrally rotate together with each other.

Figure 11:
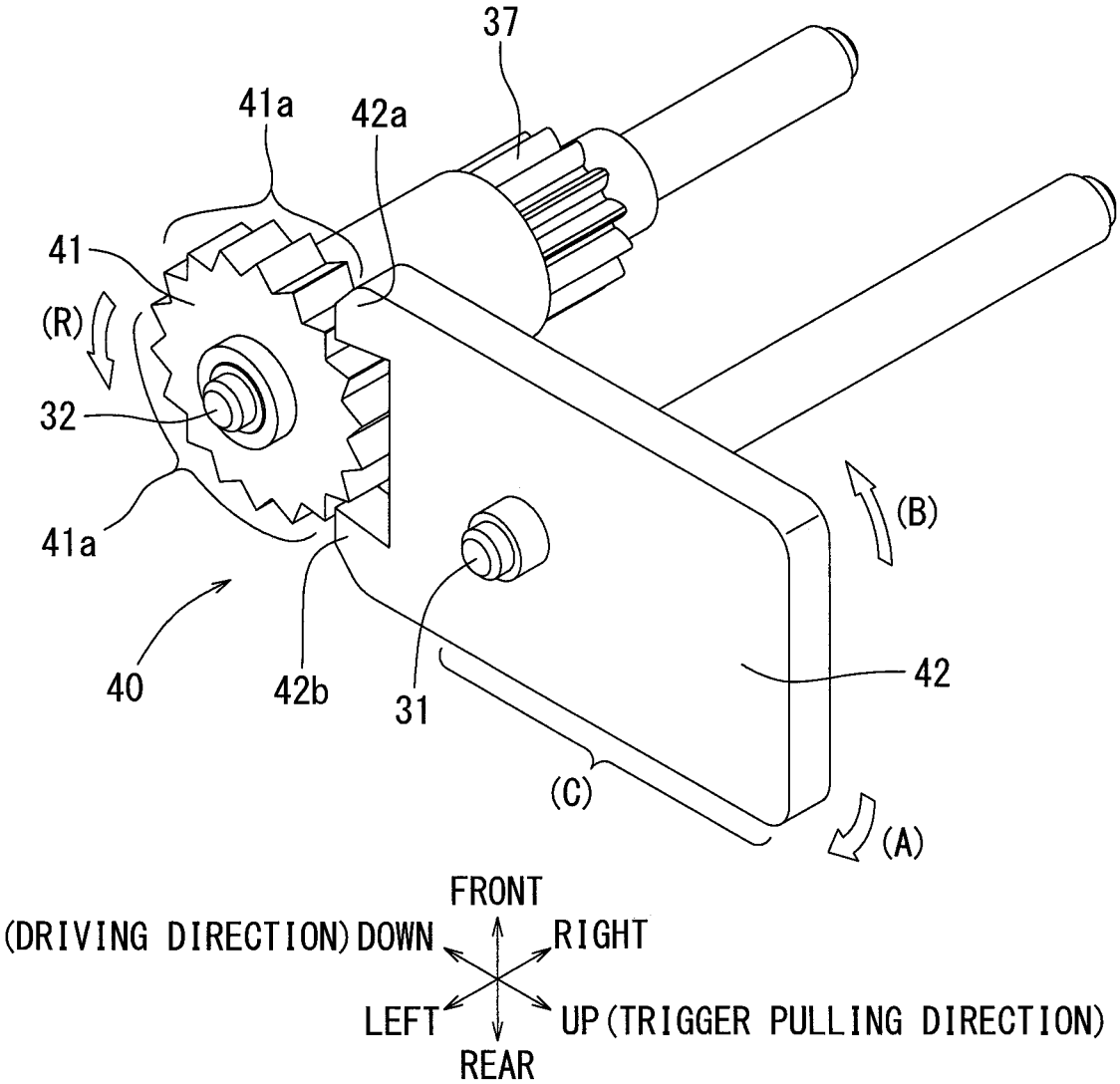
FIG. 11 is a perspective view of an intermittent rotation mechanism.

As shown in FIG. 11, the restriction wheel 41 may engage a resistance applying member 42. The intermittent rotation mechanism 40 may include the restriction wheel 41 and the resistance applying member 42. An intermittent rotation of the restriction wheel 41 may specify the predetermined time period t during which the contact restriction member 23 moves from the unlock position to the lock position. The intermittent rotation of the restriction wheel 41 may be performed in part due to the resistance applying member 42 that intermittently applies a rotational resistance to the restriction wheel 41. The restriction wheel 41 and the resistance applying member 42 in the present embodiment may correspond to, for example, an escape wheel and an anchor (or pallet) of a timepiece escapement, respectively. In a timepiece escapement, an intermittent rotation movement of the escape wheel may be performed by two portions of an anchor (engagement portions) that alternately contact (engage) the escape wheel.

As shown in FIG. 11, a plurality of ridge-shaped engagement portions 41*a* may be continuously formed on an outer circumference of the restriction wheel 41. The restriction wheel 41 may rotate only in a predetermined direction because of the presence of the clutch mechanism 35. In the present embodiment, the restriction wheel 41 may rotate in a counterclockwise direction, an embodiment of which is indicated by an arrow (R) in FIG. 11, due to the biasing force of the torsion spring 29. As the contact restriction member 23 returns to the unlock side, the restriction wheel 41 may not rotate because of the disengagement of the clutch mechanism 35.

As shown in FIG. 11, the resistance applying member 42 may be disposed above the restriction wheel 41. In the present embodiment, the resistance applying member 42 may have approximately a rectangular, flat-plate shape. The resistance applying member 42 may be supported by the gear train base 25 via the first train shaft 31 such that it can be independently swung in the front-rear direction around the first train shaft 31. The resistance applying member 42 may be swung in the front-rear direction by receiving a rotational force from the restriction wheel 41.

As shown in FIG. 11, two claws (a first claw 42*a* and a second claw 42*b*) may be formed as contact portions at a lower portion of the resistance applying member 42. The first claw 42*a* and the second claw 42*b* may be for engaging engagement portions 41*a* of the restriction wheel 41. The first claw 42*a* may be formed at a lower front corner of the resistance applying member 42. The second claw 42*b* may be formed at a lower rear corner of the resistance applying member 42. The first claw 42*a* and the second claw 42*b* may be formed and disposed in a symmetrical manner with respect to the first train shaft 31 (a swing axis).

Figure 12:
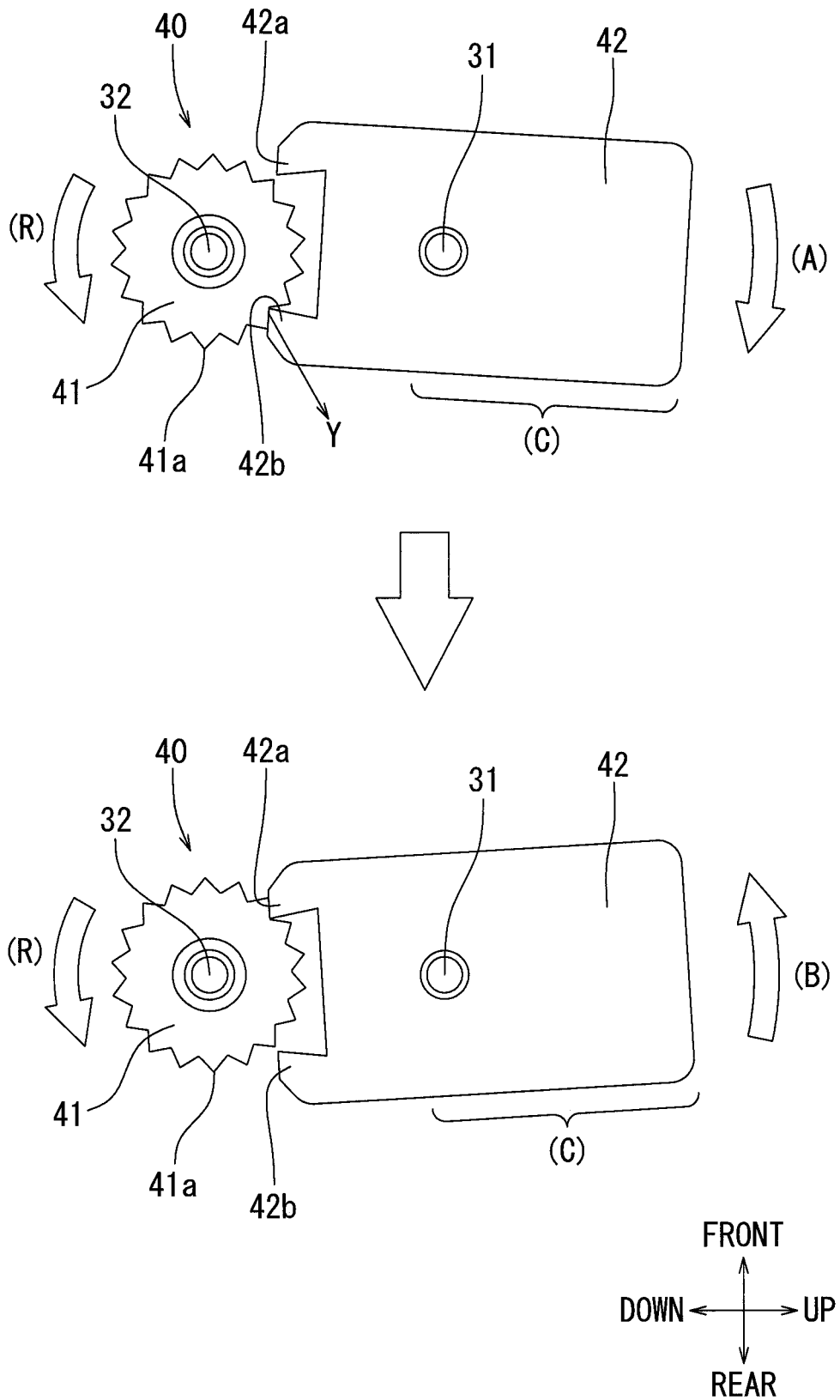
FIG. 12 is illustrative drawings of the intermittent rotation mechanism, showing a movement thereof.

By rotation of the restriction wheel 41 in the predetermined direction, an embodiment of which is shown by a void arrow (R) in FIGS. 11 and 12, the resistance applying member 42 may be swung in the front-rear direction, an embodiment of which is shown as void arrows (A) and (B) in FIGS. 11 and 12. When the resistance applying member 42 is swung in the front-rear direction, the first claw 42*a* and the second claw 42*b* may alternately contact (engage) one of the engagement portions 41*a* at regular time intervals. As shown in an upper part of FIG. 12, by rotation of the restriction wheel 41 in a direction indicated by the arrow (R), the second claw 42*b* may contact one of the engagement portions 41*a*. When the second claw 42*b* contacts one of the engagement portions 41*a*, the first claw 42*a* may be positioned apart from the engagement portions 41*a*. When the second claw 42*b* contacts one of the engagement portions 41*a*, the resistance applying member 42 may rotate in a direction indicated by an arrow (B) in FIG. 12.

In more detail, as shown in FIG. 12, when the second claw 42*b* contacts one of the engagement portions 41*a*, a rotational torque, for example in a direction indicated by an arrow (R), of the restriction wheel 41 may apply an external force (swing force Y) to the second claw 42*b* in a direction to push the second claw 42*b* rearward. A component of the vector of the swing force Y in a tangential direction of an arc having its center at the first train shaft 31 may be applied to the second claw 42*b* to rotate in the counterclockwise direction. In other words, because of the swing force Y, the resistance applying member 42 may rotate in a direction indicated by the arrow (B) in FIG. 12. In the present embodiment, a shape of the surface of the second claw 42*b* that contacts the engagement portions 41*a*, for example, a tilt angle and/or a round chamfering of the second claw 42*b* with respect to the engagement portions 41*a*, may be appropriately designed such that the swing force Y for swinging the resistance applying member 42, for instance in the direction (B), may occur.

When the resistance applying member 42 swings in the direction (B), the second claw 42*b* may disengage from the engaged portion of the engagement portions 41*a*. Upon disengagement of the second claw 42*b*, the rotation movement of the restriction wheel 41 for swinging the resistance applying member 42 in the direction (B) may be substantially and momentarily stopped. The momentary stopping time period may depend on the rotational torque of the restriction wheel 41 and the inertial torque needed for swinging the resistance applying member 42. In the present embodiment, an upper weight (which in this embodiment corresponds to an area (C) of the resistance applying member 42 of FIG. 12) of the resistance applying member 42 with respect to the first train shaft 31 may be appropriately set in order to obtain a required inertia torque.

When the second claw 42*b* disengages from the engaged portion of the engagement portions 41*a*, the restriction wheel 41 may again rotate in the direction (R). After that, as shown in a lower part of FIG. 12, the first claw 42*a* may contact one of the engagement portions 41*a*. Because of this movement, a rotational torque of the restriction wheel 41 may apply an external force to the first claw 42*a*, which may be used for swinging the restriction applying member 42 in the direction (A). As a result, the resistance applying member 42 may swing in the direction (A). In the engagement of the first claw 42*a* with one engagement portion of the engagement portions 41*a*, the rotation movement of the restriction wheel 41 may be substantially and momentarily stopped.

As discussed above, according to the alternate engagement of the first claw 42*a* and the second claw 42*b* of the resistance applying member 42, the resistance applying member 42 may be swung in the first direction (A) and in the second direction (B). During the engagement of the first claw 42*a* and the second claw 42*b*, the rotation movement of the restriction wheel 41 may be substantially and momentarily stopped. When both the first claw 42*a* and the second claw 42*b* of the resistance applying member 42 are apart from the engagement portions 41*a*, the restriction wheel 41 may rotate at a specified speed by the gear train 30 without receiving substantial rotational resistance. In this way, the restriction wheel 41 may intermittently rotate in the direction (R) while repeating a substantial and momentary stop.

Due to the intermittent rotation of the restriction wheel 41, the restriction wheel 41 may rotate at a speed lower than a speed specified by the gear train 30. As a result, a movement speed of the contact restriction member 23 from the unlock position to the lock position may be slowed, and an appropriate time t may be set. In the present embodiment, for example, the predetermined time period t required for the contact restriction member 23 to move from the unlock position to the lock position may be set to about 3 to 5 seconds. The predetermined time period t may be selectively increased or decreased by varying an intermittent rotational speed of the restriction wheel 41. For example, a rotational speed of the restriction wheel 41 may be changed by modifying a speed increasing ratio of the gear train 30. Furthermore, a rotational speed of the restriction wheel 41 may be changed by, for example, modifying a substantial and momentary stopping time of the restriction wheel 41. The substantial and momentary stopping time of the restriction wheel 41 may be appropriately set by modifying a weight of the resistance applying member 42, thereby effectively causing a change of an inertial torque for swinging the resistance applying member 42.

As discussed above, due to the speed increase by the gear train 30 and the intermittent rotation of the restriction wheel 41, the predetermined time period t required for the contact restriction member 23 to move from the unlock position to the lock position may be appropriately set. Because the timer mechanism 20 is provided between the trigger 12 and the actuation portion 6*c* of the contact arm 6, an embodiment of which was described above, an inadvertent driving operation of the tool main body 2 can be avoided when the trigger 12 is in an on-state.

As discussed above, when both the trigger 12 and the contact arm 6 are on-operated, the valve stem 11*a* may be pushed upward by the idler 19, thereby turning on the starting valve 11. By turning on the starting valve 11, compressed air may be supplied to the piston upper chamber 16, thereby performing a driving operation of the tool main body 2. In a driving operation mode (a continuous driving mode) in which the trigger 12 is on-operated at first and then the contact arm 6 is on-operated, an on-operation of the contact arm 6 may be prohibited after a predetermined time period t, set by the timer mechanism 20, has passed. A state in which the contact arm 6 is prohibited may be reset by releasing the on-operation of the trigger 12. In a driving operation mode (a single driving mode) in which the contact arm 6 is on-operated at first and then the trigger 12 is on-operated, a time limitation by the timer mechanism 20 may not occur.

In the following, an operation state of the timer mechanism 20 in each driving operation mode will be explained.

FIGS. 15 and 16 both show that the trigger 12 is in an off state and the contact arm 6 is in an off state (initial state). In the initial state, as shown in FIG. 16, the release receiving portion 23*c* may be pushed frontward by the restriction release portion 12*b* of the trigger 12. Because of this configuration, the contact restriction member 23 may be pushed frontward to and/or kept in the unlock position. Next, as shown in FIG. 17, when the contact arm 6 is pushed upward at first, the actuation portion 6*c* of the contact arm 6 may pass through or by a rear part of the restriction portion 23*b* of the contact restriction member 23 to reach an on-position. In this manner, an on-operation of the contact arm 6 may be allowed. When the contact arm 6 is on-operated, the rotation tip end of the idler 19 may be pushed upward by the actuation portion 6*c* of the contact arm 6. Because of this configuration, when the trigger 12 is subsequently on-operated, the starting valve 11 may be turned on, and a single driving operation may be performed.

Figure 18:
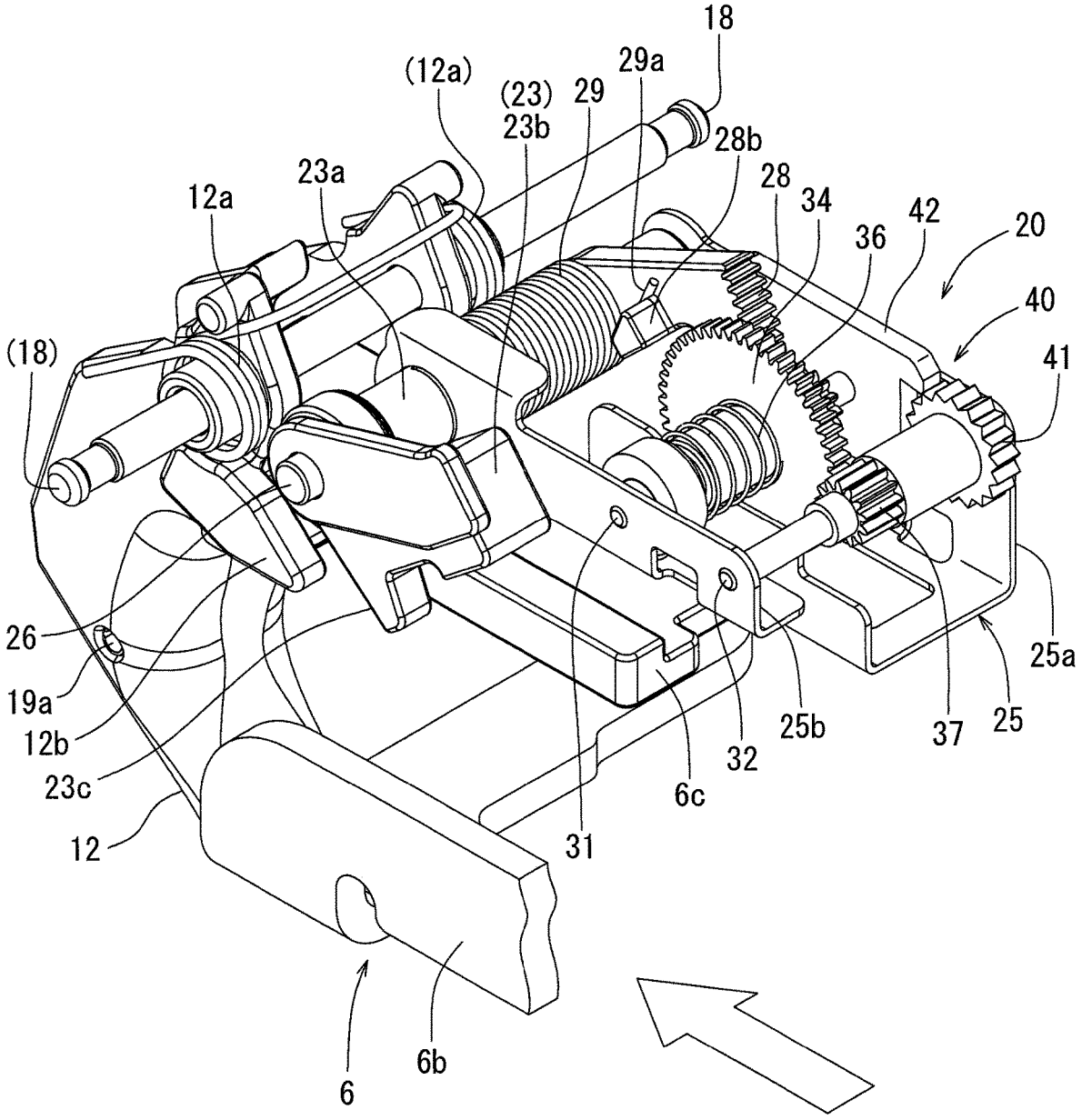
FIG. 18 is a perspective view of the timer mechanism, which is obliquely viewed from the lower-right. This figure shows that the trigger is at an on-position and the contact arm is at the on-position.
Figure 18:
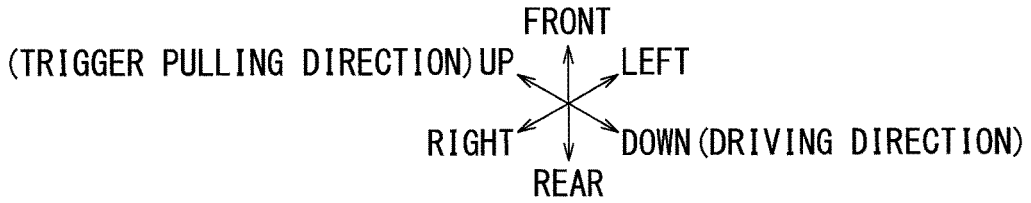

Next, a continuous driving mode will be explained. As shown in FIGS. 18-20, when the trigger 12 is pushed upward at first, an operation of the timer mechanism 20 may start. In more detail, when the trigger 12 is on-operated by being moved upward, the restriction release portion 12*b* may move upward. Because of this configuration, the release receiving portion 23*c* may be movable upward. Accordingly, the contact restriction member 23 may start to rotate toward a lock side due to the force of the torsion spring 29 (in a rearward direction in FIGS. 18-20). When the contact restriction member 23 rotates to the lock side, the restriction portion 23*b* may move rearward (to the lock side). Accordingly, the restriction portion 23*b* may enter the guide groove 17*c* of the mechanism case 17.

As shown in FIG. 18, after the trigger 12 has been on-operated, when the contact arm 6 is pushed upward before the predetermined time period t has passed, the actuation portion 6*c* may pass to a position above the guide groove 17*c* because the restriction portion 23*b* of the contact restriction member 23 had not yet reached the lock position. Because of this configuration, the contact arm 6 may be on-operated. Because the trigger 12 is on-operated and after that the contact arm 6 is on-operated, the starting valve 11 may be turned on and thus a driving operation of the tool main body 2 may be performed.

After the trigger 12 has been on-operated, if the contact arm 6 is not pushed upward before the predetermined time period t has passed, the restriction portion 23*b* of the contact restriction member 23 may enter the guide groove 17*c* so as to be in a lock state, an embodiment of which is shown in FIGS. 19 and 20. In the lock state, the restriction portion 23*b* may be in a position that it can block the lock portion 6*d* of the actuation portion 6*c*. Thus, the actuation portion 6*c* may be restricted from moving further upward. In the lock state, the contact arm 6 may be restricted from being on-operated, and thus the starting valve 11 may not be turned on. Accordingly, a driving operation of the tool main body 2 may not be performed. The unlock state of the contact arm 6 may be reset by releasing the on-operation of the trigger 12.

In either of the driving modes of the above embodiment, after a driving has been performed, if the contact arm 6 is off-operated while the trigger 12 is still being on-operated, the contact restriction member 23 may be rotatable to the lock side. Furthermore, because the trigger 12 remains on-operated, the restriction release portion 12*b* may be positioned apart above from the release receiving portion 23*c*. When the contact arm 6 is on-operated while the timer mechanism 20 is running and before the predetermined time period t has passed, another driving may be performed. If another driving operation is performed within the predetermined time period t, a sloped and/or flat upper surface of the actuation portion 6*c* of the contact arm 6 (an embodiment of which is shown in FIG. 20) may contact a lower portion of the restriction portion 23*b* of the restriction member 23. The actuation portion 6*c* of the contact arm 6 may then push the restriction member 23 frontward against the biasing force of the torsion spring 29. In part due to the clutch mechanism 35, the restriction member 23 may be quickly pushed forward. By the restriction member 23 being pushed by the actuation portion 6*c* of the contact arm 6, the restriction member 23 may be returned to or near its initial position, which in turn may essentially reset the timer mechanism 20. Accordingly, the timer mechanism 20 may be in a configuration where it can be started again. If the predetermined time period t has passed before the contact arm 6 is on-operated, an additional on-operation of the contact arm 6 may be prohibited, thereby prohibiting an inadvertent driving operation. As previously mentioned, the timer mechanism 20 may also be reset when the trigger 12 is returned to the off position, either before or after the predetermined time period t has elapsed.

As shown in FIGS. 13 and 14, a circular window 17*d* may be formed in the shield wall member 17*a* of the mechanism case 17. As shown in FIG. 14, if the restriction portion 23*b* of the contact restriction member 23 reaches the lock position after the predetermined time period t has passed, the restriction portion 23*b* may cover the window 17*d*. Because of this configuration, a user may visually recognize the presence of the restriction portion 23*b* by looking through the window 17*d*. Thus, the user may confirm that the contact arm 6 is in a lock state. Furthermore, the user may visually confirm that the contact restriction member 23 is operating normally. In contrast, as shown in FIG. 13, when the restriction member 23 is at an unlock position, the restriction portion 23*b* may not cover the window 17*d*. Accordingly, the user may visually confirm that the contact arm 6 is in an unlock state.

According to the above-exemplified embodiment, in a situation in which the trigger 12 is kept on-operated while the contact arm 6 is not being on-operated, an on-operation of the contact arm 6 may be prohibited after a predetermined time period t has passed. Because of this configuration, an inadvertent driving operation may be reliably prevented when the driving tool 1 is carried while the trigger 12 is mistakenly pull-operated.

According to the above-exemplified embodiment, the predetermined time period t may be set by utilizing an intermittent rotation movement of the restriction wheel 41. In the present embodiment, compressed air does not need to be used as a part of a power source to move operation members such as, for example, the restriction wheel 41 or the timer mechanism 20. Thus, the timer mechanism 20 may move in a smooth manner. Furthermore, in the present embodiment, a rotary damper in which silicon oil is sealed does not need to be used. Thus, an operation speed of the timer mechanism 20 may not be substantially affected by heat. As a result, the predetermined time period t may be stable at all times.

According to the above-exemplified embodiment, the timer mechanism 20 may include a plurality of stages of a gear train 30 that start to rotate due to a biasing force of a torsion spring 29 when a trigger 12 is moved to the on-position (trigger on-position). Rotation of the restriction wheel 41 may be increased through the gear train 30. Due to the increased speed of the restriction wheel 41, a diameter of the restriction wheel 41 may be reduced, thereby making the intermittent rotation mechanism 40 more compact.

According to the above-exemplified embodiment, the gear train 30 and the intermittent rotation mechanism 40 may be housed in a mechanism case 17 in a sealed manner. In more detail, the mechanism case 17 and a support portion 23*a* of the contact restriction member 23 that extends from the mechanism case 17 may be sealed by a seal member 27. Thus, a dustproof property of the gear train 30 and the intermittent rotation mechanism 4 (the timer mechanism 20) may be provided. In other words, foreign matter may be prevented from entering the mechanism case 17. As a result, the predetermined time period t may be stable.

According to the above-exemplified embodiment, the gear train 30 may include a clutch mechanism 35 in the power transmission path. Due to the disconnection of the power transmission path of the gear train 30 due to the clutch mechanism 35, the trigger 12 may rapidly return to the off-position without receiving both a movement resistance of the gear train 30 and a movement resistance of the intermittent rotation of the restriction wheel 41. A one-way clutch may be used for the clutch mechanism 35. As a result, an appropriate predetermined time period t may be obtained by a simple-structured clutch mechanism 35 and the trigger 12 may be rapidly return to the off-position.

According to the above-exemplified embodiment, the gear train 30 and the intermittent rotation mechanism 40 may be supported by the single gear train base 25. Accordingly, the gear train 30 and the intermittent rotation mechanism 40 may be assembled with the gear train base 25 with stability and accuracy. As a result, the intermittent rotation movement of the restriction wheel 41 may be stable and the predetermined time period t may be accurate and stable.

According to the above-exemplified embodiment, the restriction wheel 41 may be rotatably supported by the gear train base 25 via the second train shaft 32. The second train shaft 32 may be commonly used by the gear train 30 and the restriction wheel 41. Furthermore, the resistance applying member 42 may be swingably supported by the gear train base 25 via the first train shaft 31. The first train shaft 31 may be commonly used by the gear train 30 and the resistance applying member 42. As a result, the intermittent rotation mechanism 40, and as a result the timer mechanism 20, may be made more simple and compact.

According to the above-exemplified embodiment, the shield wall member 17*a*, which shields the contact restriction member 23 in a lateral direction, may include a window 17*d* through which the contact restriction member 23 may be visually recognized from the lateral direction (from outside of the starting device 10). By confirming the location of the contact restriction member 23 through the window 17*d*, a user may rapidly confirm a movement state of the timer mechanism 20. Furthermore, by visually confirming the movement state of the contact restriction member 23 through the window 17*d*, a user may indirectly confirm a dustproof state within the sealed mechanism 17. In other words, a user may confirm whether foreign matter has entered the mechanism case 17 and is causing an operation failure of the timer mechanism 20 or not.

The embodiments discussed above may be modified in various ways. In the present embodiment, the timer mechanism 20 may include a two-staged gear train 30, in which a first gear 28 engages a second gear 33 and a third gear 34 engages a fourth gear 37. Instead, a one-stage gear train or three-staged or more gear train may be used.

A number of engagement portions 41*a* (teeth number), or a size (diameter) of the restriction wheel 41 may be modified as needed.

In the present embodiment, the first claw 42*a* and the second claw 42*b* may be disposed symmetrically with respect to the swing axis (which in this embodiment is the first train shaft 31). Instead, the first claw 42*a* and the second claw 42*b* may be disposed asymmetrically with respect to the swing axis.

Instead of the present embodiment, a weight may be placed on the area (C) in order to make the inertial torque for swinging the resistance applying member 42 adjustable. By changing the weight, an intermittent rotation speed of the restriction wheel 41 may be modified. As a result, a predetermined time period t may be changed.

In the present embodiment, a compressed-air-driven nail gun has been exemplified as the driving tool 1. Instead, the present disclosure may be applied to a tacker or any other driving tool having a contact arm for preventing a false operation.

The above described driving tool 1 may be an example of a driving tool according to the present disclosure. The above described tool main body 2 may be an example of a tool main body according to the present disclosure. The above described trigger 12 may be an example of a trigger according to the present disclosure. The above described contact arm 6 may be an example of a contact arm according to the present disclosure. The above described contact restriction member 23 may be an example of a contact restriction member according to the present disclosure.

The above described timer mechanism 20 may be an example of a timer mechanism according to the present disclosure. The above described restriction wheel 41 may be an example of the restriction wheel according to the present disclosure. The above described resistance applying member 42 may be an example of the resistance applying member of the present disclosure.

What is claimed is:

1. A driving tool, comprising:

a tool main body that is configured to perform a driving operation on a condition that both a trigger is in a trigger-on position and a contact arm is in an arm-on position;

a contact restriction member that is configured to be movable between an unlock position, at which the contact arm is allowed to move to the arm-on position, and a lock position, at which the contact arm is prevented from moving to the arm-on position; and a timer mechanism that is configured to (i) start an operation of the timer mechanism when the trigger moves to the trigger-on position while the contact arm is at an arm-off position and (ii) move the contact restriction member to the lock position in a predetermined time period, wherein the timer mechanism includes:

a restriction wheel that is configured to specify the predetermined time period by rotation of the restriction wheel; and a resistance applying member that (i) is configured to intermittently apply a rotational resistance to the restriction wheel, (ii) is swingably linked to the tool main body and (iii) includes a contact portion that is configured to intermittently contact the restriction wheel.

2. The driving tool according to claim 1, wherein the restriction wheel and the contact restriction member are configured such that the rotation wheel rotates in an interlocking relationship with a movement of the contact restriction member to the lock position.

3. The driving tool according to claim 2, wherein the contact restriction member and the trigger are configured such that the movement of the contact restriction member is performed when the trigger is at the trigger-on position.

4. The driving tool according to claim 1, wherein the restriction wheel is configured to apply a force to the contact portion of the resistance applying member by rotation of the restriction wheel in a certain direction, thereby causing the resistance applying member to swing.

5. The driving tool according to claim 1, wherein the contact portion of the resistance applying member includes two claws, the two claws being configured to alternately contact the restriction wheel.

6. The driving tool according to claim 4, wherein the resistance applying member is symmetric with respect to a line passing through a swing center thereof.

7. The driving tool according to claim 1, wherein the timer mechanism includes a plurality of stages of a gear train configured to transmit a rotational movement of the gear train to the restriction wheel with increased speed when the trigger is at the trigger-on position.

8. The driving tool according to claim 7, wherein the restriction wheel is rotatably supported via a first shaft of the gear train.

9. The driving tool according to claim 7, wherein the resistance applying member is swingably supported via a second shaft of the gear train.

10. The driving tool according to claim 7, wherein a one-way clutch is included in a power transmission path of the gear train.

11. A driving tool, comprising:

a tool main body that is configured to perform a driving operation on a condition that both a trigger is in a trigger-on position and a contact arm is in an arm-on position;

a contact restriction member that is configured to be movable between an unlock position, at which the contact arm is allowed to move to the arm-on position, and a lock position, at which the contact arm is prevented from moving to the arm-on position; and a timer mechanism that is configured to (i) start an operation of the timer mechanism when the trigger moves to the trigger-on position while the contact arm is at an arm-off position and (ii) move the contact restriction member to the lock position in a predetermined time period, wherein the timer mechanism includes:

a restriction wheel that is configured to specify the predetermined time period by rotation of the restriction wheel; and a resistance applying member that is configured to apply a rotational resistance to the restriction wheel in an intermittent manner such that the resistance applying member rotates alternately in a clockwise direction and in a counterclockwise direction.

12. The driving tool according to claim 11, wherein the restriction wheel and the contact restriction member are configured such that the rotation wheel rotates in an interlocking relationship with a movement of the contact restriction member to the lock position.

13. The driving tool according to claim 12, wherein the contact restriction member and the trigger are configured such that the movement of the contact restriction member is performed when the trigger is at the trigger-on position.

14. The driving tool according to claim 11, wherein the resistance applying member is swingably linked to the tool main body and includes a contact portion that is configured to intermittently contact the restriction wheel.

15. The driving tool according to claim 14, wherein the contact portion of the resistance applying member includes two claws, the two claws being configured to alternately contact the restriction wheel.

16. The driving tool according to claim 14, wherein the resistance applying member is symmetric with respect to a line passing through a swing center thereof.

17. The driving tool according to claim 11, wherein the timer mechanism includes a plurality of stages of a gear train configured to transmit a rotational movement of the gear train to the restriction wheel with increased speed when the trigger is at the trigger-on position.

18. The driving tool according to claim 17, wherein a one-way clutch is included in a power transmission path of the gear train.

19. A driving tool, comprising:

a tool main body that is configured to perform a driving operation on a condition that both a trigger is in a trigger-on position and a contact arm is in an arm-on position;

a contact restriction member that is configured to be movable between an unlock position, at which the contact arm is allowed to move to the arm-on position, and a lock position, at which the contact arm is prevented from moving to the arm-on position; and a timer mechanism that is configured to (i) start an operation of the timer mechanism when the trigger moves to the trigger-on position while the contact arm is at an arm-off position and (ii) move the contact restriction member to the lock position in a predetermined time period, wherein:

the timer mechanism includes:

a restriction wheel that is configured to specify the predetermined time period by rotation of the restriction wheel; and a resistance applying member that is configured to intermittently apply a rotational resistance to the restriction wheel;

both the restriction wheel and the resistance applying member are sealed and housed in a mechanism case;

the mechanism case includes a shield wall member configured to shield the contact restriction member in a lateral direction; and the shield wall member includes a window through which the contact restriction member can be visually seen when the contact restriction member is in the lock position.

* * * * *